US009111413B2

(12) United States Patent
Gagner et al.

(10) Patent No.: US 9,111,413 B2
(45) Date of Patent: Aug. 18, 2015

(54) DETECTION AND RESPONSE TO AUDIBLE COMMUNICATIONS FOR GAMING

(71) Applicant: WMS Gaming, Inc., Waukegan, IL (US)

(72) Inventors: Mark B. Gagner, West Chicago, IL (US); Damon E. Gura, Chicago, IL (US); Sean P. Kelly, Chicago, IL (US); Jesse M. Smith, Chicago, IL (US); Matthew J. Ward, Northbrook, IL (US)

(73) Assignee: WMS Gaming, Inc., Waukegan, IL (US)

( * ) Notice: Subject to any disclaimer, the term of this patent is extended or adjusted under 35 U.S.C. 154(b) by 0 days.

(21) Appl. No.: 13/786,879

(22) Filed: Mar. 6, 2013

(65) Prior Publication Data

US 2013/0337889 A1 Dec. 19, 2013

Related U.S. Application Data

(60) Provisional application No. 61/659,792, filed on Jun. 14, 2012.

(51) Int. Cl.
*G07F 17/32* (2006.01)

(52) U.S. Cl.
CPC ..... *G07F 17/323* (2013.01); *G07F 17/3206* (2013.01); *G07F 17/3209* (2013.01)

(58) Field of Classification Search
CPC ..... G07F 17/3237; G07F 17/323; G07F 17/3239; G07F 17/3209
USPC ..... 463/25, 29, 35, 42
See application file for complete search history.

(56) References Cited

U.S. PATENT DOCUMENTS

| | | | | |
|---|---|---|---|---|
| 6,676,523 | B1 | 1/2004 | Kasai et al. | |
| 8,138,930 | B1 | 3/2012 | Heath | |
| 2004/0044574 | A1 | 3/2004 | Cochran et al. | |
| 2004/0073482 | A1 | 4/2004 | Wiggins et al. | |
| 2004/0152514 | A1 | 8/2004 | Kasai et al. | |
| 2005/0170890 | A1 * | 8/2005 | Rowe et al. | 463/42 |
| 2005/0228797 | A1 | 10/2005 | Koningstein et al. | |
| 2006/0058102 | A1 * | 3/2006 | Nguyen et al. | 463/39 |
| 2007/0083408 | A1 | 4/2007 | Altberg et al. | |
| 2008/0109317 | A1 | 5/2008 | Singh | |

(Continued)

FOREIGN PATENT DOCUMENTS

EP 1064975 3/2001

OTHER PUBLICATIONS

"Kinect", *Wikipedia* http://en.wikipedia.org/wiki/Kinect Date Obtained from the Internet: Jun. 15, 2010 Last Date Modified Jun. 6, 2012, 15 pages.

Microsoft, "Capturing Audio Data in C#", *MSDN Library* http://msdn.microsoft.com/en-us/library/hh855349.aspx Date Obtained from the Internet: Jun. 15, 2012, 2 pages.

Microsoft, "Microsoft Kinect for Windows SDK—V1.0 Release Notes", *Kinect for Windows* http://www.microsoft.com/en-us/kinectforwindows/develop/release-notes.aspx Date Obtained from Internet: Jun. 15, 2012 Last Date Modified: May 2, 2012, 5 pages.

*Primary Examiner* — James S. McClellan
*Assistant Examiner* — Kevin Carter
(74) *Attorney, Agent, or Firm* — DeLizio Law, PLLC

(57) ABSTRACT

A wagering game system and its operations are described herein. In some embodiments, the operations can include detecting one or more audible communications made during a wagering game session, evaluating the one or more audible communications in context with gaming information associated with the wagering game session; and presenting an automated response to the one or more audible communications based on the evaluating of the one or more audible communications in context with gaming information.

27 Claims, 11 Drawing Sheets

(56) References Cited

U.S. PATENT DOCUMENTS

| | | | | |
|---|---|---|---|---|
| 2008/0147488 | A1 | 6/2008 | Tunick et al. | |
| 2009/0270170 | A1* | 10/2009 | Patton | 463/36 |
| 2010/0036717 | A1 | 2/2010 | Trest | |
| 2010/0317437 | A1* | 12/2010 | Berry et al. | 463/35 |
| 2011/0009193 | A1* | 1/2011 | Bond et al. | 463/36 |
| 2011/0092288 | A1* | 4/2011 | Pryzby et al. | 463/35 |
| 2011/0223993 | A1* | 9/2011 | Allen et al. | 463/30 |

* cited by examiner

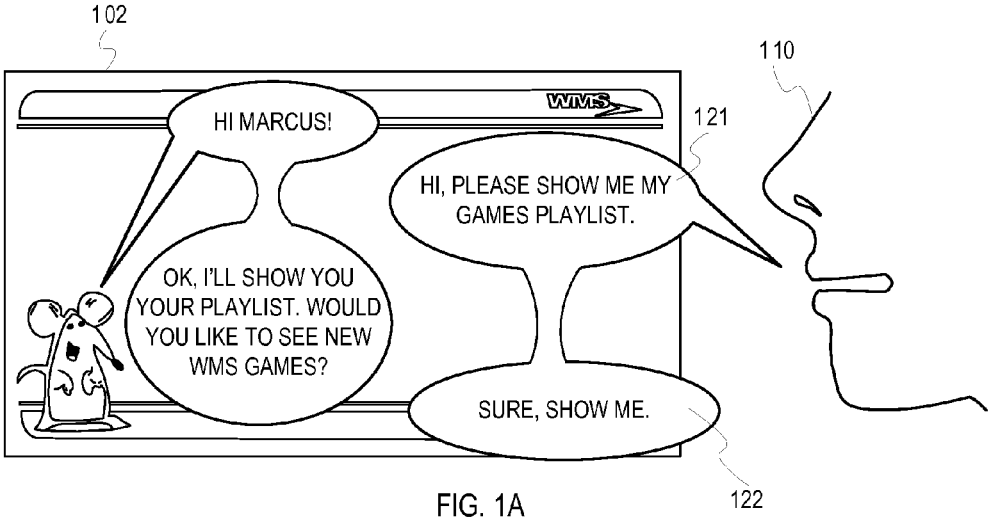

FIG. 1A

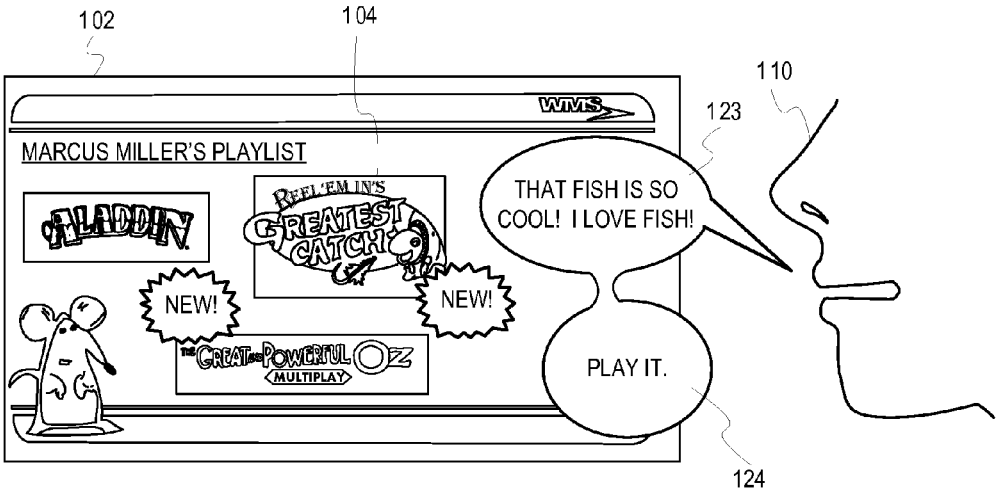

FIG. 1B

| 116 SUGGESTIONS MADE | 117 COMMUNICATIONS DETECTED | | 118 | 119 |
|---|---|---|---|---|
| | DIRECT | INDIRECT | | RESPONSE TO COMMANDS OR COMMENTS |
| | PLEASE SHOW ME MY GAMES PLAYLIST. | | | SHOW PLAYLIST OF PREFERRED GAMES. |
| WOULD YOU LIKE TO SEE NEW WMS GAMES? | SURE,SHOW ME. | | | SHOW NEW GAMES |
| | PLAY IT. | THAT FISH IS SO COOL! I LOVE FISH! | | 1. LAUNCH "REEL 'EM IN'S: GREATEST CATCH" APPLICATION.<br>2. OFFER EXTRA FISH CHARACTER.<br>3. SET MENU OPTIONS TO FISH THEME WHEN ACCESSED. |

FIG. 1C

DETECTION AND RESPONSE TO AUDIBLE COMMUNICATIONS FOR GAMING

LIMITED COPYRIGHT WAIVER

A portion of the disclosure of this patent document contains material that is subject to copyright protection. The copyright owner has no objection to the facsimile reproduction by anyone of the patent disclosure, as it appears in the Patent and Trademark Office patent files or records, but otherwise reserves all copyright rights whatsoever. Copyright 2013, WMS Gaming, Inc.

TECHNICAL FIELD

Embodiments of the inventive subject matter relate generally to wagering game systems and networks that, more particularly, detect sounds and voices.

BACKGROUND

Wagering game machines, such as slot machines, video poker machines and the like, have been a cornerstone of the gaming industry for several years. Generally, the popularity of such machines depends on the likelihood (or perceived likelihood) of winning money at the machine and the intrinsic entertainment value of the machine relative to other available gaming options. Where the available gaming options include a number of competing wagering game machines and the expectation of winning at each machine is roughly the same (or believed to be the same), players are likely to be attracted to the most entertaining and exciting machines. Shrewd operators consequently strive to employ the most entertaining and exciting machines, features, and enhancements available because such machines attract frequent play and hence increase profitability to the operator. Therefore, there is a continuing need for wagering game machine manufacturers to continuously develop new games and gaming enhancements that will attract frequent play.

Furthermore, during gaming sessions (e.g., during periods of wagering game play) players tend to communicate a variety of thoughts and emotions both verbally and non-verbally. Gaming entities, such as wagering game machine manufacturers, gaming venue operators, and wagering game providers, would like to understand players' communications and emotions to improve the gaming experience.

BRIEF DESCRIPTION OF THE DRAWING(S)

Embodiments are illustrated in the Figures of the accompanying drawings in which:

FIGS. 1A-1C are illustrations of detecting and responding to audible communications for gaming, according to some embodiments;

DESCRIPTION OF ILLUSTRATIVE EMBODIMENTS

Figure 2:
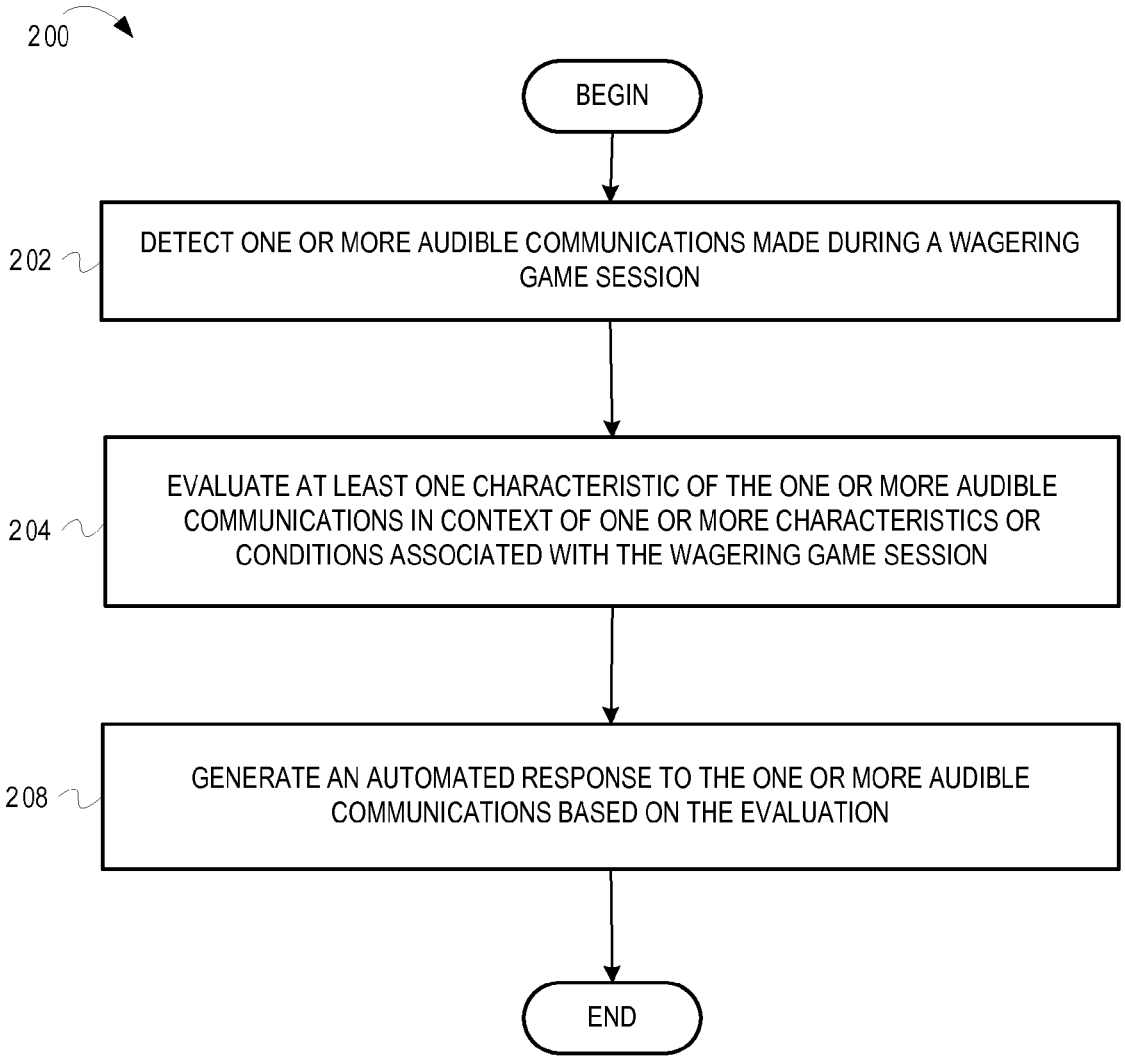
FIG. 2 is a flow diagram ("flow") 200 illustrating detecting and responding to audible communications via gaming, according to some embodiments.

This description of the embodiments is divided into four sections. The first section provides an introduction to embodiments. The second section describes example operations performed by some embodiments while the third section describes example operating environments. The fourth section presents some general comments.

Introduction

This section provides an introduction to some embodiments.

As described previously, gaming entities, such as wagering game machine manufacturers, gaming venue operators, and wagering game providers, would like to understand players' communications and emotions. Some embodiments of the present inventive subject matter include detecting audible communications made by a player, and other individuals within a gaming venue, during a gaming session. Some embodiments further include analyzing, or evaluating, the audible communications (e.g., audible words, sounds, etc.) in context of a scenario in which the audible communication was made. For instance, some embodiments include evaluating information the player communicates, and evaluating how the player communicates the information, to determine a meaning for the audible communication. Some embodiments include evaluating a history of communications that the player has previously made. Some embodiments include evaluating the information communicated by the player in context of wagering game content presented, or presentable, during the wagering game session. For instance, a player's audible communication may refer to gaming content presented during the wagering game session, such as commands for a wagering game system to perform certain wagering game actions, expressions of confusion or frustration about certain wagering game features, and so forth. In response, a wagering game system can automatically respond to the player's audible communications, such as by performing actions, suggesting alternative content, providing encouragement and/or rewards, etc. Another embodiment includes detecting passive comments made by a player, detecting background conversations between the player and other individuals near the player, or detecting other such indirect or passive communications (e.g., communications that are not directed specifically at a wagering game machine). Some embodiments include responding to the indirect communications with subtle suggestions for content, or for subtle changes of content. These are but a few examples. Many more are described in further detail below.

FIGS. 1A-1C are illustrations of detecting and responding to audible communications for gaming, according to some embodiments. In FIG. 1A, a wagering game system ("system") presents a user interface ("interface") 102 that indicates communications made with an individual, such as a wagering game player ("player") 110. The system can include one or more microphones to detect audible communications made by the player 110. In some embodiments, the audible communications can be verbal expressions (e.g., spoken words) or non-verbal expressions (e.g., grunts, whistles, groans, etc.). The system can further include cameras, sensors, or other equipment to record physical characteristics of the player 110 associated with the audible communications, such as gestures, facial expressions, eye movement, body language, etc. The system can interpret the meaning of the audible communications made by the player 110 and respond to the audible communications. For example, the system detects that the player 110 logs in to a wagering game machine and begins a wagering game session. The system greets the player by name (e.g., "Hi Marcus."). The system detects a first audible communication 121 made by the player 110 (e.g., "Hi, please show me my games playlist."). In response, the system determines an opportunity to suggest new content to the player 110 (e.g., "I will show you your playlist. Would you like to see new WMS games?"). The system detects a second audible communication 122 by the player 110 (e.g., "Sure, show me."). The system determines, based on the context of the conversation, that the second audible communication 122 by the player 110 refers to the suggestion made by the system immediately before. In other words, the system determines that the statement of "Sure, show me" made by the player 110 refers to the system's immediately preceding statement of "Would you like to see new WMS games?" and, based on the closeness in time ("temporal proximity") of the two statements the system determines that they are related. Therefore, the system determines a meaning of the second audible communication 122 by the player 110 based on an analysis of the history of communications. The system can evaluate a variety of characteristics related to the communication, the player, wagering game content, the environment, other individuals, account information, or any other element associated with the scenario in which the communication was made. Based on evaluation of the characteristics, the system can respond to the audible communications 121 and 122 in a variety of ways.

In FIG. 1B, in response to the second audible communication 122 made by the player 110, the system presents, via the user interface 102, a playlist of wagering games including a graphic 104 that indicates a new wagering game. The system detects a third audible communication 123 by the player 110 (e.g., "That fish is so cool! I love fish."). The system determines that the third audible communication 123 is not a direct command for the system to respond to immediately, but is instead an indirect comment that the player 110 makes. Consequently, the system does not respond to that comment but stores the information for future reference (e.g., stores the information that the player 110 thinks that "That fish is so cool" and "I love fish"). Subsequently, the system detects a fourth audible comment 124 (e.g., "Play it.") made by the player 110. The system determines, in context of what is presented on the user interface 102 (e.g., in context of the graphic 104 having an image of a fish and having metadata that indicates a fish graphic) and in context of what the player 110 has recently said (e.g., in context of the player having recently said, "That fish is so cool! I love fish!"), that the fourth audible communication 124 (i.e., "Play it") is referring to a wagering game associated with the graphic 104 (e.g., the "Reel 'Em In's: Greatest Catch" wagering game). The system then responds by opening, or launching, the wagering game associated with the graphic 104. The system may present the wagering game via a gaming device, such as a wagering game machine, configured to present a variety of different types of wagering games.

In FIG. 1C, the system tracks communications in a table 115 for reference. The table 115 may be a part of a file system and/or associated with a database. The table 115 indicates some of the communications tracked by the system, such as suggestions 116 made to the player 110 (e.g., "Would you like to see new games?"), direct communications 117 detected from the player 110 (e.g., "Please show me my games playlist.", "Show me.", "Play it"), and indirect communications 118 detected from the player 110 (e.g., "That fish is so cool!" and "I love fish!"). The table 115 also indicates responses 119 made by the system to the communications. For instance, the table 115 indicates that the system showed a playlist of preferred games in response to a command (e.g., in response to the phrase "Please show me my games playlist."). In another example, the table 115 indicates that the system showed a listing of new games in response to a different command (e.g., in response to the phrase "Sure show me."). Furthermore, in response to another command (e.g., in response to the phrase "Play it . . . ") the system launches a wagering game application (e.g., the "Reel 'Em In's: Greatest Catch" wagering game application). In response to an indirect comment made by the player 110 (e.g., in response to the comment "I like fish . . . "), the system determines to offer a fish character to the player 110 and to set menu options for a player account associated with the player 110 to show a fish theme the next time that the player 110 accesses the menu options via the player account.

In FIGS. 1A-1C, the system responds automatically to audible communications according to some examples. However, FIGS. 1A-1C only present some examples of automated responses based on an audible communication. Other examples of automated responses based on an audible communication are explained in detail further below in conjunction with other figures. Automated responses can be performed immediately (e.g., in direct response to a direct audible communication), or delayed, (e.g., in response to an indirect audible communication). Some automated responses change or prevent presentation of content or activity. Some examples of responding to an audible communication include, but are not limited to:

- Directly responding to commands requests, or queries. For instance, in FIGS. 1A-1C, the system launched a wagering game in response to a direct command.
- Presenting information related to wagering games, the player, other players, etc. For example, the system presents information about wagering, denominations, bonus games, game rules, pay tables, player account information, social contacts of a player (e.g., friends and family), group members of a community wagering game, etc.
- Providing shortcuts to certain features, help files, etc. For example, in response to a player audibly communicating with the system, the system can offer shortcuts or help files that would normally take many screen interactions to view if the player was not communicating audibly with the system.
- Suggesting content. For instance, in FIGS. 1A-1C, the system suggested new wagering games in response to a player's request to view a playlist. Other examples may include detecting an audible communication that indicates frustration or lack of understanding of a wagering game and, in response, the system suggests other, less complicated games to play. In some examples, the system listens to comments made by a player regarding game play, and, in response, offers suggestions for play, bonus content, etc. For example, the system detects a player comment that expresses confusion with a game (e.g., "Why am I not in this bonus round") or an expression of frustration or disappointment (e.g., "Awe, so close" or "I always get a 7-7-Bar" which indicates a player's frustration with a near-win in a wagering game). In response to the player comments of confusion, frustration, or disappointment, the system offers encouragement, such as playing a replay of the last time the player won a game to excite and encourage the player. In another example, the system suggests games where the player may have won given the same player activity. In some embodiments, the system suggests types of games that are less volatile (e.g., games that pay out more often, but pay out less per pay out than other, more volatile games that payout less often, but with higher payout amounts). In yet other examples, the system offers rewards, such as customized content or content that comports with a player's preferences. The system can store data about the player's preference for specific volatilities and use that information to suggest games subsequently, present subsequent types of bonuses, etc.

Changing content type, features, or characteristics. For example, if a player says "Awe that would have won if it was on a line" or "If only I had a wild reel" regarding a near win, the system determines that the player has a specific understanding of the game mechanics and rules and, in response, the system can enhance or focus certain graphics, information, or other content to more specifically highlight certain features about the game that the player cares about. For example, the system can suggest specific advanced game strategies, suggest changes to numbers of pay lines and/or denominations, etc. In some embodiments, the system changes graphics, music, etc. according to a player's indication of preference. For example, if a player says, "I like fish," the system can automatically change a wagering game theme to a nautical theme with fish graphics and ocean sounds.

Presenting advertisements, marketing content and rewards. In some embodiments, in response to audible communications, the system can offer in-game advertisements (e.g., banners, pop-ups, etc.), marketing offers or rewards (e.g., dinner offers for entertainment or shows, travel discounts, etc.), and so forth.

Further, some embodiments of the inventive subject matter describe examples of detection and response to audible communications for gaming in a network wagering venue (e.g., an online casino, a wagering game website, a wagering network, etc.) using a communication network, such as via one of various types of communications network that provides access to wagering games, such as a public network (e.g., a public wide-area-network, such as the Internet), a private network (e.g., a private local-area-network gaming network), a file sharing network, a social network, etc., or any combination of networks. Multiple users can be connected to the networks via computing devices. The multiple users can have accounts that subscribe to specific services, such as account-based wagering systems (e.g., account-based wagering game websites, account-based casino networks, etc.).

Further, in some embodiments herein a user may be referred to as a player (i.e., of wagering games), and a player may be referred to interchangeably as a player account. Account-based wagering systems utilize player accounts when transacting and performing activities, at the computer level, that are initiated by players. Therefore, a "player account" represents the player at a computerized level. The player account can perform actions via computerized instructions. For example, in some embodiments, a player account may be referred to as performing an action, controlling an item, communicating information, etc. Although a player, or person, may be activating a game control or device to perform the action, control the item, communicate the information, etc., the player account, at the computer level, can be associated with the player, and therefore any actions associated with the player can also be associated with the player account. Therefore, for brevity, to avoid having to describe the interconnection between player and player account in every instance, a "player account" may be referred to herein in either context. Further, in some embodiments herein, the word "gaming" is used interchangeably with "gambling."

Although FIGS. 1A-1C describe some embodiments, the following sections describe many other features and embodiments.

Example Operations

This section describes operations associated with some embodiments. In the discussion below, some flow diagrams are described with reference to block diagrams presented herein. However, in some embodiments, the operations can be performed by logic not described in the block diagrams.

In certain embodiments, the operations can be performed by executing instructions residing on machine-readable storage media (e.g., software), while in other embodiments, the operations can be performed by hardware and/or other logic (e.g., firmware). In some embodiments, the operations can be performed in series, while in other embodiments, one or more of the operations can be performed in parallel. Moreover, some embodiments can perform more or less than all the operations shown in any flow diagram.

FIG. 2 is a flow diagram ("flow") 200 illustrating detecting and responding to audible communications via gaming, according to some embodiments. In FIG. 2, the flow 200 begins at processing block 202, where a wagering game system ("system") detects one or more audible communications made during a wagering game session. In some embodiments, the system detects the one or more audible communications using one or more microphones ("microphone(s)"). In some embodiments, the microphone(s) are associated with a wagering game machine (e.g., 3D microphones), or other gaming devices situated within a gaming venue, such as a casino. In some embodiments, the microphone(s) can be associated with a mobile device carried by a user or individual. The mobile device can convey the audible communications to a gaming device, such as to a wagering game machine or a wagering game server. The system can detect the audible communication from one or more sources (e.g., players, casino patrons, or other individuals) within a given proximity to the microphone(s). The audible communication can be spoken words or phrases, vocal sounds (e.g., yells, grunts, groans, etc.), oral noises (e.g., lip popping or buzzing, whistling, tongue clicking, etc.), physical movement or activity (e.g., shuffling of feet, walking or jumping, movement of clothing, clapping, tapping, drumming, banging, knuckle cracking, etc.), sounds made by a device (e.g., a clicking of a personal item or playing implement such as clicking a pen, tapping a playing wand, playing with a mobile phone, etc.) or other sounds. In other words, an individual can communicate using sounds in many ways, only some of which are verbal.

The flow 200 continues at processing block 204, where the system evaluates at least one characteristic of the one or more audible communications in context of one or more characteristics or conditions associated with the wagering game session. The system can detect and analyze characteristics of the audible communication (e.g., inflection, volume, words, etc.) and compare the characteristics against libraries, files, databases, or other collections of data, that indicate a description or meaning for the characteristics. For instance, the system can detect a spoken phrase by an individual and cross-reference the spoken phrase to a library of known terms. Characteristics of an audible communication can include characteristics of how, when, where, and by whom, the audible communication is made. Characteristics or conditions associated with a wagering game session can include information associated with wagering game content, wagering game rules or mechanics, a wagering game machine, a history of game play, wagering game events, game play achievements, betting amounts, player-account information, group game data, secondary gaming content (e.g., secondary wagering games, community games, progressives, etc.), casino services, persistent or episodic wagering games, environmental conditions in a gaming venue, or any other information associated with gaming.

The flow 200 continues at processing block 206, where the system generates an automated response to the one or more audible communications based on the evaluation. In other words, the system automatically generates a response based on the evaluation of the characteristic(s) of the audible communication(s) in context of the one or more characteristics or conditions associated with the wagering game session. The automated response can take a variety of different forms, some of which may include wagering game content, encouraging messages, advertisements, suggestions for content, help tips, replays of gaming events, and so forth.

The following includes some descriptive elements pertinent to the flow 200 of FIG. 2.

In some embodiments, the system evaluates whether the audible communication should be responded to, or whether the audible communication requires clarification or authorization.

In some embodiments, the system determines whether the audible communication originates within a given proximity to a wagering game machine and, in response, determines whether to further evaluate the audible communication or generate an automated response. The system can disregard, or filter out, audible sounds that are detected from beyond the proximity (e.g., ignores sounds that occur too far away from the wagering game machine). For instance, the system filters out ambient noises that come from the wagering game machine or from nearby machines or patrons. In some embodiments, the system uses microphones in a chair of the wagering game machine to detect sounds that come from, or that are directed to, the player. In some examples, the system determines the location of the origin of the audible communication via multiple microphones and/or specialized microphones (e.g., 3D microphones) and/or via visual confirmation from cameras.

In some embodiments, the system determines whether the audible communication originates from a specific player associated with the wagering game session. For instance, the system detects unique voice characteristics of the player via biometrics, and verifies that the voice characteristics are a biometric match to the player who has logged in to the wagering game machine.

In some embodiments, the system generates a relevance score of the audible communication and, based on the relevance score, determines a degree of clarification or authorization to request within the automated response. The system can determine the degree of clarification or authorization proportional to the relevance score. For example, if the audible communication is related to a wager or an amount to wager, the system may assign a high relevance value, and may present a prompt asking the player if they intended to bet more. For instance, the system detects the words "I'd like to bet more" but, before making another wager or before increasing a betting amount, the system may ask, for clarification, (e.g., the system asks "Did you just say 'I'd like to bet more.'?", "Did you want to make a bet?", or "Did you want to increase your betting amounts?"). In some embodiments, the system may hear a grunt or groan and may ask the player additional clarifying questions (e.g., "Are you upset?" or "Is there anything I can do for you?"). In some embodiments, the system presents a prompt or confirmation message on a display for touch approval.

Furthermore, the system can determine the degree of priority to assign to the automated response based on the relevance score. For example, based on an emotion or preference detected from the audible communication, the system may determine a timing for response, a degree of encouragement to include in a response, a degree of marketing or advertising to target via the response, a type of content to present or suggest in a response, etc.

In some embodiments, the system determines to respond based on whether the content of the audible communication is decipherable. In some embodiments, the system responds only to comments that contain phrases or words that are similar to data within a library, knowledgebase, etc. (e.g., only data in a game knowledgebase). In other words, the system can filter the audible communications, and provide responses based only on the relevance of the audible communication to the wagering game content. For instance, the system detects and parses an audible communication, and compares the parsed components of an audible communication to words or phrases in a library of words and phrases that have been pre-determined to be relevant to the wagering game content. The system then analyzes the comparison of the parsed components of the audible communication to the library (e.g., analyzes the comparison of words from the player to the words in the library) to generate a relevance score. Based on the relevance score, the system can determine that, based on a specific value of the relevance score, the system can perform, or not perform, certain actions. The system can also generate an automated response to contain a degree of requests for clarification or a degree of authorization of actions (e.g., prior to performing the actions) proportional to the relevance score. For instance, the system may refrain from generating an automated response if a comment is determined to have a low relevance score (e.g., if the comment's relevance score does not exceed a lower limit or relevance threshold). As certain degrees of relevance scores increase, the system can respond proportionately, such as to prompt additional questions for higher relevance scores (e.g., "Can you rephrase that comment?", "Are you speaking to me?", "What do you mean by double-down, do you want me to double your bet on the next spin?", etc.). Based on the value of the relevance scores, the system can present direct vocal confirmations (e.g., "Ok, I'll do that" or "I will double your next bet, please confirm by saying OK"). Further, based on the relevance scores, the system can perform direct actions (e.g., present a listing of new games, increase a wager amount, presents specific content).

In some embodiments, the system evaluates characteristics of an audible communication against data sources to determine a meaning for the audible communication.

In some embodiments the system evaluates characteristics of audible communications against entries in a variety of different types of data sources, such as libraries, files, records, databases, etc., such as, but not limited to, the following: a library of word definitions, a library of colloquialisms, a library of languages or dialects, a library of elements of speech, a library of non-verbal sounds, a library of sounds made by a device, a library of vocal tones that indicate emotion, a record of one or more additional audible communications made by an individual from whom the one or more audible communications originated, a record of one or more additional audible communications made by one of a plurality of individuals in proximity to a wagering game machine associated with the wagering game session, etc. In some embodiments, the data source is specifically tuned to a venue within which the audible communication occurs. For example, the data source may include specific references to unique elements, shops, shows, services, etc., associated with a venue. Based on the evaluation of the characteristics of audible communications against descriptions within the data sources, the system can determine a meaning of an audible communication.

In some embodiments, the system evaluates new content of the audible communication in context.

In some embodiments, the system detects an audible communication that contains new content (e.g., new words or phrases) that the system has not detected before and that is not within a library of known phrases. The system can evaluate the new content of the audible communication in context of the situation in which the audible communication was made (e.g., in context of characteristics of the individual who made the communication, in context of a mode of expression, in context of gaming information presented or presentable during a wagering game session, in context of a history of audible communications, etc.). Based on the evaluation, the system can determine how, or whether, to respond to the audible communication. For example, the system may present a wagering game called "The Great and Powerful Oz" during a wagering game session. During that session, the system detects a comment to "Pay no attention to the man behind the curtain." The system can analyze the statement (e.g., search through a database, a player profile, a network, the Internet, etc.) to determine that the phrase refers to a line from the movie "The Wizard of Oz" on which the wagering game is based. The system interprets the audible communication as being related to the wagering game, such as being related to a character in the game and further interprets the comment to not display the specific character or to perform some other action related to the character. In some embodiments, the system can present a response that asks for more information (e.g., "The Great and Powerful Oz requests that you clarify what you mean by Pay no attention to the man behind the curtain."). In some embodiments, when the system cannot detect a meaning for the audible communication, the system can disregard the content of the communication and/or store the content for later reference. In some embodiments, the system stores any or all forms of communication, whether audible or inaudible, verbal or non-verbal, for reference and/or analytics.

In some embodiments, the system evaluates the content of the audible communication (e.g., evaluates what was said in the audible communication) as well as characteristics of an expression of the audible communication (e.g., evaluates how the communication was expressed).

In some embodiments, the system detects and evaluates nonverbal elements of speech related to the audible communication. For instance, the system detects and determines levels and/or fluctuations in volume, pitch, voice quality, rate, speaking style, rhythm, intonation, stress, inflection, etc., associated with the audible communication. In some embodiments, the system detects types of non-spoken sounds (e.g., grunts and groans). In some embodiments, the system detects body language and/or gestures. In some embodiments, the system evaluates the nonverbal elements of speech, or other expressions of the audible communication, and uses them to detect emotions or other indicators of meaning (e.g., detect a calm emotion from subdued and quiet speech, detect an excited or frustrated emotion from direct and forceful speech, etc.).

In some embodiments, the system detects an audible communication made in a passive tone, but determines that the content of the audible communication suggests a direct command or direct request of the system. For example, the system detects that a player says, "I have no idea how I won." instead of "Why did I win?" The first comment ("I have no idea how I won") is not a direct command or direct request for the system to tell the player why the player won, but it strongly suggests that the player is interested in knowing something about the mechanics of the game. The system can determine whether the player has a history of using the passive tone in speech and, based on that history, determine that a comment made in a passive tone is actually a direct request or command.

In some embodiments, the system detects physical aspects of an individual who makes the audible communication to determine a sense of emotion (e.g., negative, positive, or neutral) for the individual. For example, the system monitors an individual using recording equipment or other sensors (e.g., cameras, pressure sensors, heart-rate monitors, temperature sensors, etc.) that detect physical appearance, activity, biometric function, movement, etc. In some examples, when the individual makes an audible communication (e.g., whether verbal or non-verbal, such as a grunt or groan), the system can record an image of the individual's face and body to detect visible signs of heightened emotion, such as wincing, a furrowed brow, specific types of movement (e.g., shifting in a chair, jittery movement, hand-wringing, excessive tapping of the fingers, etc.) and so forth. In other examples, sensors in a chair can detect when a player is sitting on an edge of the seat or slumped down in the chair, which indicate clues to specific types of emotions. The system can analyze all physical aspects of the individual to give meaning to the audible communication.

Based on the evaluation of the expression of the audible communication, and said detection of emotion, the system can apply a meaning to the audible communication. For instance, the system refers to a library of descriptions of emotions and/or potential meanings associated with emotions, and, in context of the detected emotions, and other audio cues (e.g., verbal elements of speech such as spoken words from the communication) and/or visual cues taken from the audible communication, the system determines a most probable meaning from the library. The system can further refer to libraries associated with word definitions, languages or dialects, elements of speech, non-verbal sounds, sounds made by a device, vocal tones, etc.

In some embodiments, the system evaluates an audible communication in relation to wagering game content presentable via the wagering game machine, or other information associated with wagering games.

In some embodiments, the system detects verbal commands for a wagering game to perform an action or present content (e.g., "Play it.", "Bet max.", etc.). The system can evaluate the command against data associated with the wagering game. For instance, the system can detect that a command is associated with a specific object or event of the wagering game content (e.g., a character, a title, a theme, a graphic, an accomplishment, a wager, etc.). For instance, in FIG. 1, when the player 110 said, "Play it," the system determined that, based on the gaming content presented via the user interface 102, the player was referring to a specific wagering game.

In some embodiments, the system detects a query or request for information about the wagering game content (e.g., "Why did I not win?" "How do you get to the bonus options?" "How do you play the bonus round?" "Show the game rules." "Show the pay table." "How many lines does the game have?" "What are the betting options?" "Who is this Wizard of Oz character?"). For instance, the system can detect that the audible communication is associated with a point of game play within a wagering game and responds accordingly (e.g., when a player says "I wonder how I won?" or "How did I lose?" the system detects a point in play, as well as any recent gaming events, and generates an explanation or help tip related to game rules.)

In some embodiments, the system detects a request for a specific type of content or feature (e.g., "Show me games about racing.") The system detects queries about the player's own play or general play history for a game (e.g., "Why did I win?" "Show me my wins." "Show me all the big wins that have occurred for this game in the last 6 weeks." "When did this machine last go into a bonus round?" "I want to play the game I played last week." "How long since my last bonus round?"), queries about locations of friends, queries about how to contact other social contacts (e.g., send an invitation to a friend on Facebook™ with similar interests or questions, such as someone who knows how to play the game that the player is playing, present a list of individuals who are available within a casino, etc.), a question or request for a casino service ("Please send the waiting staff" "Where is my drink?"), and so forth.

In some embodiments, the system evaluates characteristics of the audible communication against a library of gaming terms or verbal game commands associated with the wagering game content. For example, the system includes a library of words, phrases, descriptions, metadata, etc., associated with wagering game content. In some embodiments, the system evaluates audible communications against metadata associated with one or more of wagering game content presentable during the wagering game session. In some embodiments, the system evaluates audible communications against one or more of game rules and game mechanics. In some embodiments, the system evaluates audible communications against a history of game play for a wagering game machine associated with the wagering game session.

In some embodiments, the system evaluates the audible communication in relation to a gaming event (e.g., in relation to a description of an event, in relation to metadata of the event, in relation to a timing of an event, etc.).

In some embodiments, the system determines that the audible communication is immediately followed, or preceded, by a specific game event. For example, when a player says "Awe, so close" the system detects that the wagering game had, on its last spin or play, experienced a near-win or almost resulted in a winning outcome based on game rules, game element configurations, etc. In some embodiments, the system refers to a log of wagering game events for a wagering game session to detect the specific game event. The log can be stored on a wagering game machine, a wagering game server, or any other gaming device associated with a wagering game network or other gaming venue (e.g., an online gaming server).

In some embodiments, the system evaluates audible communications against a library of descriptions of wagering game events. In some embodiments, the system evaluates audible communications against metadata associated with wagering game events of the wagering game session.

In some embodiments, the system evaluates the audible communication in context to additional communications or a history of communications made.

In some embodiments, the system detects additional audible communications made prior to, or concurrent with, or after, an audible communication. The system analyzes the additional audible communications for clues or indications of what the first audible communication means. For instance, the system detects that a player groans, and also detects that another individual says "Too bad." Based on the groan by the player, and the additional comment by other individual, the system interprets the grunt or groan as a negative communication, or a communication that expresses a negative emotion by the player. If, however, the other individual had instead said "Wow, nice win!" then the system interprets the groan as positive communication. The system further generates the automated response based on context of the audible communication to the one or more of the additional audible communications and the wagering game information.

In some embodiments, the system tracks a history of communications made by the source of the audible communication and analyzes the audible communication in context of the history of communications. For example, the system determines a meaning of a comment based on a history of communications. In FIG. 1, for instance, when the player 110 says "Play it," the system knows that the phrase "Play it" is referring to the fish game because (1) the system reviews a history of comments and detects that the "I love fish" comment was made very recently (e.g., within the last one or few comments) and (2) because the wagering game "Reel 'Em In's: Greatest Catch" is the only wagering game title presented via the interface 102 that depicts a fish.

In some embodiments, the system evaluates communications in context to a characteristic of the source of the communication.

In some embodiments, the system detects one or more characteristics of the source of the audible communication. For instance, the system can determine a position, orientation, or location of an individual who made the audible communication, such as whether the individual is seated in front of the wagering game machine, whether the player's eyes are looking at the display of the wagering game machine or away from the machine, etc. In some embodiments, the system utilizes player-tracking techniques, such as head tracking. In some embodiments, the system can refer to a map of an area within a gaming venue and overlay the position of individuals onto the map to determine distances from a wagering game machine or other positions relative to the wagering game machine and/or relative to other individuals. In some embodiments, the system utilizes geo-positioning and/or geo-locationing (e.g., global position systems, radio-frequency location systems, etc.).

In some embodiments, based on the one or more characteristics of the source of the audible communication, the system determines whether the audible communication is a direct command to perform an action or present content related to the wagering game session or whether the audible communication is an indirect comment (e.g., an off-hand remark or background conversation) that the system can utilize to control or present content or to enhance the wagering game experience.

In some embodiments, the system refers to a library of specific words or phrases that indicate direct commands as well as specific words or phrases that indicate indirect comments.

In some embodiments, the system generates responses to address negative player emotions.

In some embodiments, the system generates an automated response that addresses a negative emotion detected via evaluation of the audible communication. A player is continuously providing user feedback to gaming events in the forms of audible and physical reactions. Much of that user feedback is not intentionally directed to the system but is, nonetheless, communicated. For example, the system may detect an inflection of the vocal quality of an audible communication, which inflection indicates a negative tone or emotion of the player associated with game play. In another example, the system may determine that the language of the audible communication indicates a negative perception of wagering game content (e.g., confusion, frustration, disappointment, lack of understanding regarding game functionality, etc.). When the system detects negative user feedback, the system can provide a positive response to counteract the emotional negativity. For instance, the system can present a help tip or suggestion for play strategy if the audible communication indicates that the player is confused. In another example, the system can present an encouraging remark or a replay of a past win if the audible communication indicates disappointment with a lack of winning. In another example, the system can suggest additional content that may be easier to understand or have more entertainment value if an audible communication indicates a lack of comprehension of game mechanics. In yet another example, the system can provide a reward or compensation to lighten a player's mood.

In some embodiments, the system generates responses in context.

In some embodiments, based on an evaluation of a scenario during a wagering game session, the system generates a response that is customized to the scenario so that the system does not always respond to the same type of audible communication the same way each time. For example, in some embodiments, the system generates an automated response that has a presentation characteristic that is in accordance with a characteristic of the source or a characteristic of the audible communication (e.g., detect a language, age, gender, country of origin, dialect, speech pattern, personality, mood, etc. of a player that speaks the audible communication and adapts the response to have a quality that mimics, compliments, or in some other way uses the characteristic of the source). In another embodiment, the system generates an automated response with a constructed element of speech (e.g., vocabulary, language, grammar, dialect, speech pattern, etc.), that mirrors the element of speech of the audible communication. The system can parse the meaning of words based on user dialects or information from a user profile. In some examples, the system can automatically translate languages and dialects spoken by the user. In some examples, the system matches dialects to the content. In some examples, the system can detect characteristics of the player such as personality type, mood, gender, age, education, profession, country of origin, ethnicity, marital status, and demographics. The system can store files regarding the player's speech, or other characteristics, for future reference.

In some embodiments, the system generates an automated response that has characteristics of a specific person or personality, such as a celebrity, that the player prefers or that is similar to the player is some way (e.g., based on a player's age, the system responds in a celebrity's voice who would have been popular in the player's youth). In some examples, the system can generate automated responses using an avatar. In some examples, the avatar's personality can adapt to game history or game characteristics as well as to characteristics of the player or to preferences of the player. In some embodiments, the avatar can be a concierge or a game agent. In some embodiments, the avatar agent acts as a communication facilitator. An avatar can be a representation of the system and/or of the player or other players. In some examples, the avatar can act as a personal agent to the player that performs certain actions in response to player comments and/or that represents the player based on comments from other players (e.g., another player sends a chat message, but the avatar responds saying that the player is busy). In some embodiments, the avatar can respond using voice characteristics that are similar to the player. In some embodiments, the avatar grows and progresses according to the player's use of the system.

In some embodiments, during a chat session, the system can automatically translate a language of a first individual, who sends the chat message, to the language of a second individual, who receives the chat message.

In some embodiments, the system provides non-monetary incentives, such as incentivizing more vocal interaction with virtual rewards or types of wagering games that have specific features that occur only when the player uses the vocal interaction. Therefore, based on a player's degree of voice interaction, the system can present customization that is specific to each player or degree of interaction during the wagering game session.

In some embodiments, automated responses can vary based on location. For example, in response to the query, "Who's playing onstage tonight," the system would have a different answer at each casino. In some embodiments, the system includes an operator interface configuring a library of potential responses for a given facility.

In some embodiments, the system presents an offer of a reward to discuss a topic, detects that the audible communication is associated with the topic, and presents the reward. In some examples, the system provides marketing offers, coupons, and compensations as an incentive to get the user to speak and interact with a wagering game machine. In some examples, the incentives can include offers for nearby products or services. In some embodiments, the system offers game rewards such as modified reel symbols or bonus games. In some embodiments, the system sends a communication to a vendor so that the vendor can provide rewards and/or compensations to the player for talking about a particular product or service while at the wagering game machine.

In some examples, the system listens to a chat or reads the text from a chat and responds by inviting others to play or interact with the game. In some embodiments, the system can integrate into the chat a player's voice, a voice of an avatar, or a voice of a character in a game. The system can listen into a chat conversation and provide contextual suggestions via a chat console.

In some embodiments, the system evaluates communications in context of multiple sources of communication.

Figure 3:
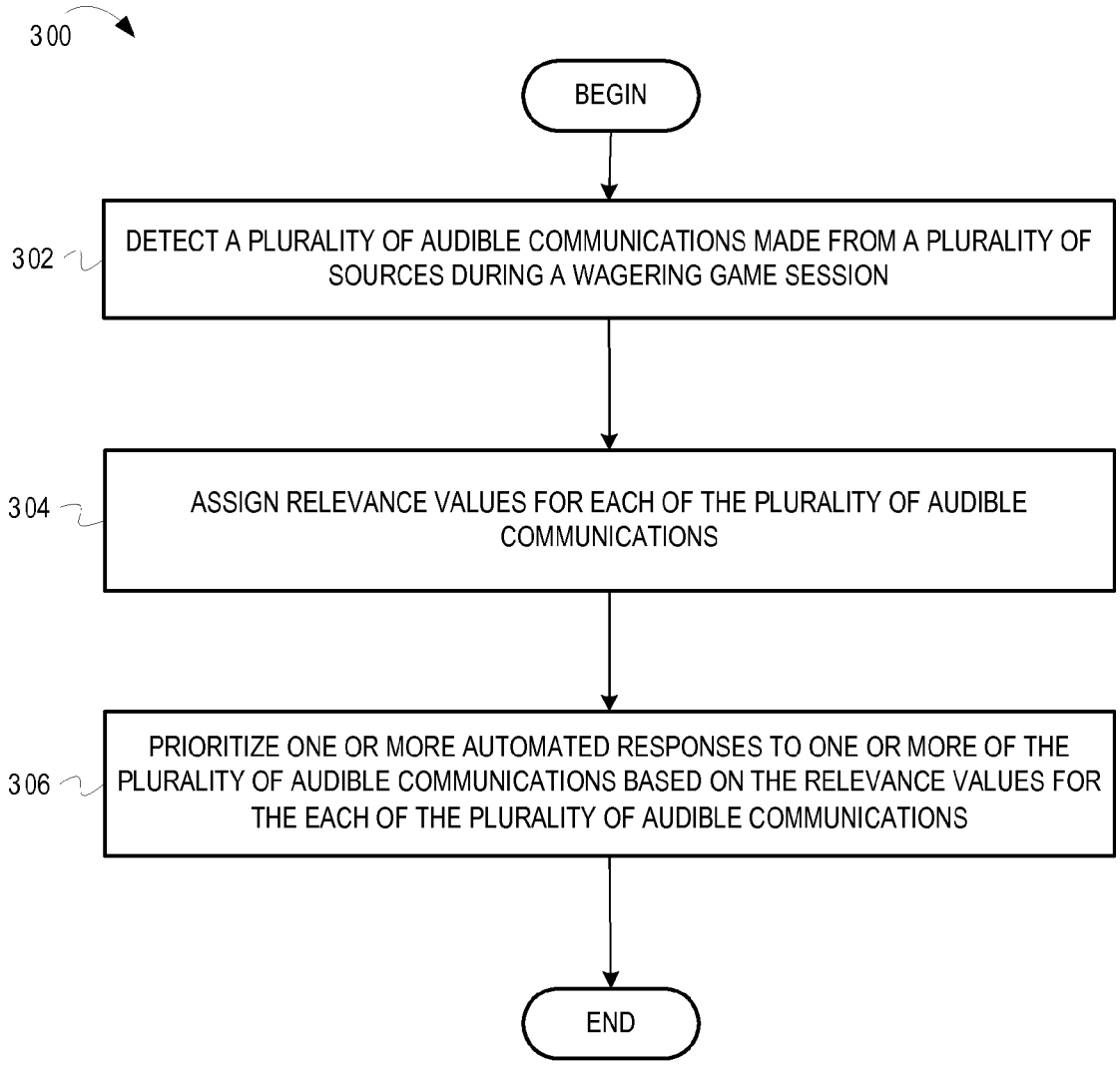
FIG. 3 is a flow diagram ("flow") 300 illustrating detecting audible communications from a plurality of individuals via gaming and prioritizing one or more responses accordingly, according to some embodiments.

In some embodiments, the system detects audible communications from various individuals and evaluates and/or responds any one or more of the audible communications. For example, the system determines which of a plurality of individuals expresses the audible communication, or by what manner the individual or individuals generates or expresses audible communications. In some embodiments, the system detects multiple audible communications and prioritizes the communications based on source, content, etc. FIG. 3 illustrates an example. FIG. 3 is a flow diagram ("flow") 300 illustrating detecting audible communications from a plurality of individuals via gaming and prioritizing one or more responses accordingly, according to some embodiments. In FIG. 3, the flow 300 begins at processing block 302, where a wagering game system ("system") detects a plurality of audible communications made from a plurality of sources during a wagering game session. The flow 300 continues at processing block 304, where the system assigns relevance values to each of the plurality of audible communications. The flow 300 continues at processing block 306, where the system prioritizes one or more automated responses to one or more of the plurality of audible communications based on the relevance values for the each of the plurality of audible communications.

Figure 4:
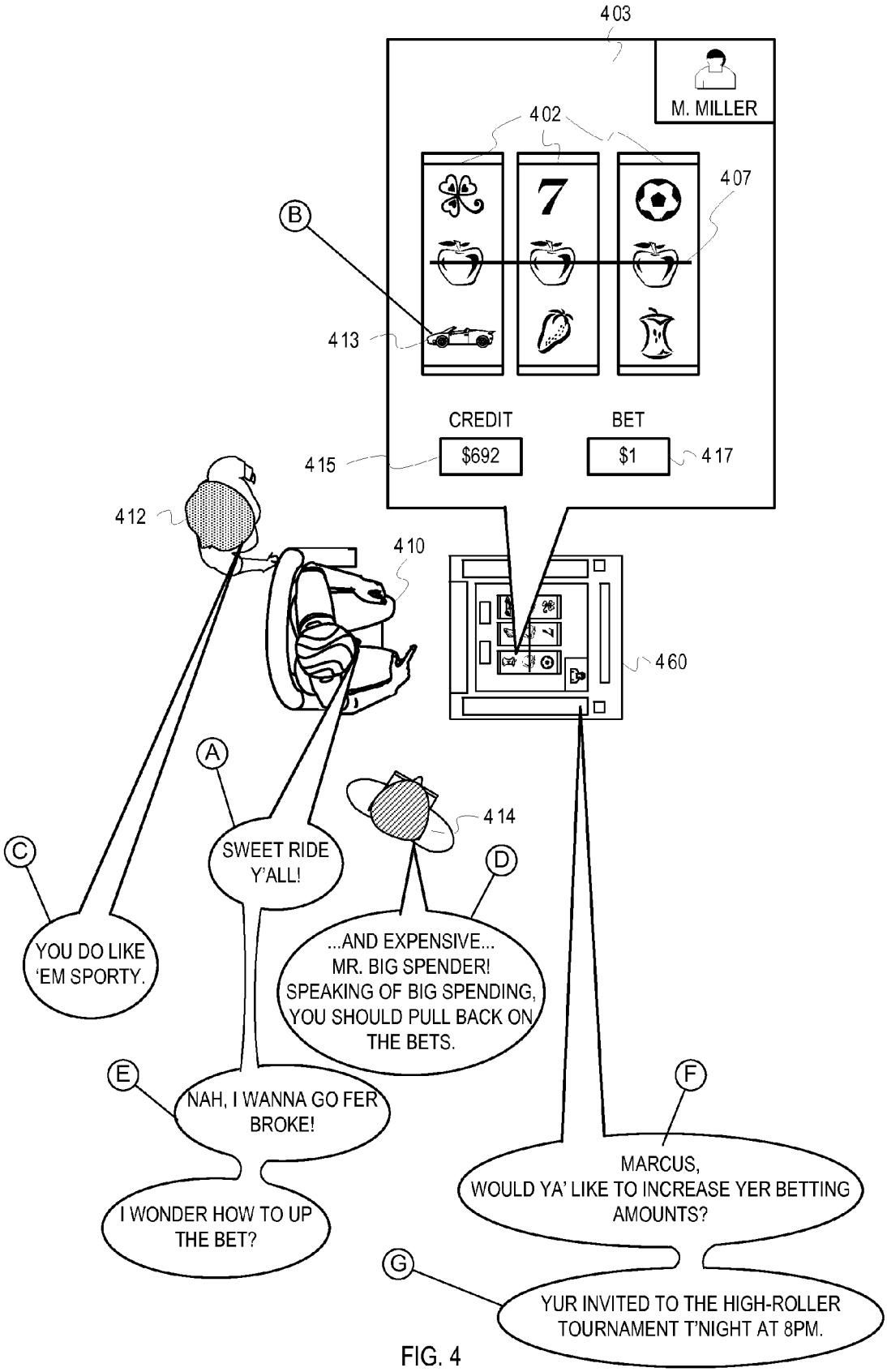
FIG. 4 is an illustration of detecting and responding to audible communications from a plurality of individuals via gaming, according to some embodiments.

One example of the concept described in FIG. 3 is illustrated in FIG. 4. FIG. 4 is an illustration of detecting and responding to audible communications from a plurality of individuals via gaming, according to some embodiments. In FIG. 4, a player 410 participates in a wagering game session using a wagering game machine 460. The wagering game machine 460 presents wagering game content 403, such as slot reels 402 or other gaming type elements (e.g., poker cards, etc.), one or more paylines 407, a credit meter 415 to track a monetary session balance and a bet meter 417 to indicate an amount bet for each round of wagering for the wagering game content 403. The player 410 is within a given distance range to other individuals 412 and 414, all of which are within a given proximity or distance range to the wagering game machine 460 and/or to the player 410. The system (e.g., via microphones attached to the wagering game machine 460 or elsewhere within the gaming venue) detects audible communications made from the player 410 and the other individuals 412 and 414 and distinguishes which of the individuals make specific sounds. In some examples, the system recognizes voice characteristics of the player 410 and/or the other individuals 412 and 414 (e.g., via voice recognition and/or biometric analysis) to determine who is communicating at any given moment. In some embodiments, the system detects the directionality of the audible communications, such as via multiple microphones (e.g., microphone arrays) or specialized microphones (e.g., three-dimensional (3D) microphones) and/or via visual confirmation from cameras that record movement of individuals mouths, hand gestures, or other visible indicators that someone is communicating. For example, if multiple individuals are speaking, the system uses 3D microphones to detect and determine directionality of the voices to determine the locations of the individuals relative to each other and/or relative to the wagering game machine 460. The system can determine, based on the directionality of the voices, which is the player 410 and which are the other individuals 412 and 414. In some embodiments, the system analyzes the audible communications with respect to the one or more sources of the communications and/or one or more other characteristics associated with the wagering game content 403 and presents an automated response customized to the source. For instance, the system detects when one of the individuals indicates a preference for specific gaming content. In FIG. 4, for example, at stage "A," the player 410 makes a statement, "Sweet ride, y'all." The system then determines, at stage "B," that the player is referring to an element of the wagering game content 403, such as the symbol 413, which has the appearance of a racecar. The system analyzes the scenario to determine a meaning for the phrase "Sweet ride y'all!" For example, the system detects various conditions or characteristics associated with the player 410, the wagering game content 403, the other individuals 412 and 414, etc. For example, in response to detecting the phrase "Sweet ride, y'all!" the system detects, via eye-tracking techniques, that the player 410 is looking at the symbol 413 and/or is gesturing to the symbol 413. In another example, in response to detecting the phrase "Sweet ride, y'all!", the system determines that one or more objects from the wagering game content 403 include metadata, such as topical tags, that characterizes the object. For instance, the symbol 413 may have metadata that indicates that the symbol 413 is a "car, racecar, sports car, vehicle, racing, luxury car, expensive car" and so forth. In another example, in response to detecting the phrase "Sweet ride, y'all!", the system scans through a library of colloquial terms that indicates that the term "ride" can refer to a vehicle and that the phrase "sweet ride" is a colloquialism that indicates a preference for a vehicle. In another example, the system scans through a history of gaming events to determine that the symbol 413 was not presented in the previous reel-stop configuration and/or appears for the first time. The system analyzes any, or all, of the example conditions or characteristics indicated above and, based on the analysis, determines that the player 410 has a preference for the particular vehicle depicted by the symbol 413. The system can further determine that the player 410 is associated with a player account and can generate an automated response that is customized to the player account. For example, the system includes a copy of an image of the symbol 413 in one or more player account menus. If one of the other individuals 412 or 414 had indicated a preference for the wagering game content 403 the system could customize a response for the other individuals 412 or 414 (e.g., if individual 412 has said "this looks like a fun game" the system detects, via voice recognition of the individual 412, that the individual 412 is associated with a specific player account, and, in response to detecting the comment "this looks like a fun game" the system presents a recommendation to the individual 412 the next time that the individual 412 initiates a subsequent wagering game session).

In some embodiments, the system generates relevance values for the plurality of sources of the communications (e.g., based on identity, location, position, etc.). For example, in FIG. 4, the system detects, at stage "C," an audible communication (e.g., "You do like 'em sporty") made by the individual 412 to the player 410 in reference to the audible communication made by the player 410 in stage "A" about the preference for the image of the racecar depicted by the symbol 413. Furthermore, at stage "D," the system detects an audible communication (e.g., " . . . and expensive . . . Mr. Big Spender!Speaking of big spending, you should pull back on the bets . . . ") made by the individual 414 to the player 410 in reference to the audible communication made by the individual 412. The system further detects, at stage "E" an additional audible communication (e.g., "Nah, I wanna go fer broke! I wonder how to up the bet?") made by the player 410 in response to the audible communication made by the individual 414. The system detects, by the various audible communications, that the individual 414 suggests a diminishment of wagering (i.e., "You should pull back on the bets.") and a contrary preference by the player 410 to increase betting (i.e., "I wanna go fer broke!"). In determining how to respond to the various audible communications, such as in determining how to address the apparent contradiction of preferences between the player 410 who wants to increase betting and the individual 414 who suggests a preference for the player 410 to reduce betting, the system determines, and assigns, relevance values for the player 410 and the individual 414. The system can assign a relevance to the individuals and/or their comments based on various factors such as the location of the individuals relative to each other and/or in relation to the wagering game machine 460, a social relationship or hierarchy between individuals (e.g., a spousal relationship, a fiduciary relationship, etc.), a relationship to a player account (e.g., whether the player 410 has indicated that the individual 414 has decision making authority for the player 410 regarding finances), and so forth. For example, the system may, in some instances, assign a highest priority value to the player 410 because the player 410 is seated at, and logged into, the wagering game machine 460 for the wagering game session using a player account. The system, in some instances, assigns lower priority values to the individuals 412 and 414. Therefore, in some embodiments, such as at stage "F," the system prioritizes an automated response based on the relevance values. For instance, the system asks the player 410 regarding an increase in betting (e.g., "Marcus, would ya' like to increase yer betting amounts?") as opposed to suggesting a decrease in betting. In other embodiments, however, the system may assign a higher priority to the individual 414 based on other reasons. For instance, if the player 410 has assigned the individual 414 as an authorized individual to assist the player 410 in tracking betting to prevent over spending, the system can recognize the authorization and, in response, assign a higher priority value to the individual 414 for monetary and betting related conversation. In some embodiments, the system can, at the outset of the wagering game session or prior to that, ask the player to indicate who is authorized for specific topics or reasons (e.g., "Who is authorized to track betting and spending?"). The system can prompt the individual 414 to speak into a microphone to detect voice characteristics so that the system can recognize specific speech characteristics of the individual 414 for future reference (e.g., unique vocal characteristics for biometric identification and verification). In some embodiments, the player 410 indicates via a player account one or more social contacts that are authorized, such as a player account associated with the individual 414. Based on voice recognition and/or biometrics, the system detects the identity of the individual 414 when the individual 414 speaks.

In some embodiments, the system tracks (e.g., detects and stores) a history of communications made by the plurality of sources and analyzes audible communications in context of the history of communications to determine the meanings of certain communications, to generate customized responses, to better facilitate communications with and between individuals, etc. For example, in FIG. 4, the individual 414, at stage "D," says the phrase "Mr. Big Spender." The system analyzes the phrase in context of the communications made during, prior to, or after the communications at stage "D." For example, the system analyzes the comment "Mr. Big Spender" in context of the comment made by the player 410 at stage "A," that indicates a preference for an expensive looking car (e.g., the system detects, via reference to a dictionary of colloquialisms, that the phrase "Big Spender" refers to someone who spends a lot of money and the system determines that the player 410 had recently indicated a preference for a high-end, or expensive type of vehicle). Furthermore, the system determines that, based on the audible communications made by the player 410 and individual 412, that the player 410 is male whereas the individual 412 is female. Thus, the word "Mr." spoken by individual 414 is referring to a male, not to a female. Furthermore, in context of an immediacy of a response by the player 410 (e.g., the "Nah I wanna go for broke!" comment made by the player 410 in direct and immediate response to the "You should pull back on the bets." comment made by the individual 414,) the system can determine that the entirety of the communication made at stage "D" is directed to the player 410. Therefore, based on the analysis of the conversation between the player 410 and the individuals 412 and 414, the system determines that the phrase "Mr. Big Spender" is most likely referring to the player 410 and that at least one person who presumably knows the player 410 thinks that the player 410 is a heavy spender or makes expensive purchases. The system can also store the phrase "Mr. Big Spender" for future reference as a pseudonym for the player 410, to communicate with the player 410, to suggest content, etc. (e.g., to suggest higher betting options, luxurious or expensive looking content or services, etc.). In some examples, based on the determination that the player 410 likes to spend heavily or make expensive purchases, the system, at stage "G" invites the player to participate in a "high-roller" tournaments. The system can delay the response at stage "G" to be at a later time period after the conversations of stages "A" through "F" (e.g., after a specified time period, after the individuals 412 and 414 have left, in response to a later gaming event, etc.).

In some embodiments, the system evaluates passive, or indirect, characteristics of communication in context.

Figure 5:
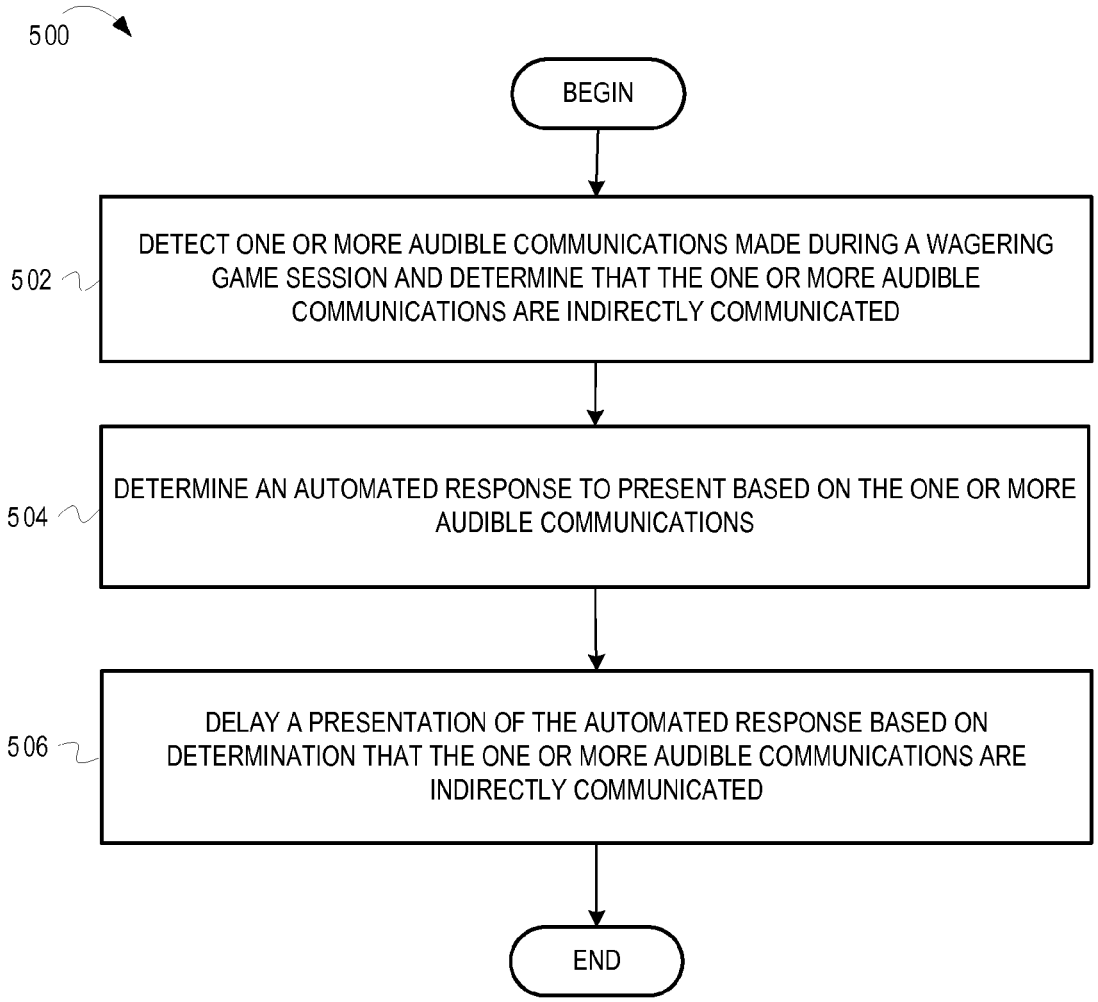
FIG. 5 is a flow diagram ("flow") 500 illustrating detecting and responding to indirect audible communications via gaming, according to some embodiments.

In some embodiments, the system determines whether the audible communication is a passive communication spoken indirectly (i.e., not spoken directly to a wagering game device as a direct query or command), such as a background comment. FIG. 5 illustrates an example. FIG. 5 is a flow diagram ("flow") 500 illustrating detecting and responding to indirect audible communications via gaming, according to some embodiments. In FIG. 5, the flow 500 begins at processing block 502, where a wagering game system ("system") detects one or more audible communications made during a wagering game session and determines that the one or more audible communications are indirectly communicated. In some embodiments, the system listens to (e.g., eavesdrops on) a player and other patrons. For example, the system can eavesdrop on background comments (e.g., detect offhand comments or background conversations) made within a certain range to a wagering game machine. In some embodiments, the system determines that the one or more communications are indirect by analyzing a tone, or other non-verbal element of speech. For instance, if the volume and tone of the audible communication sound subdued and passive, the system classifies the audible communication is indirect. In some embodiments, the system detects characteristics of an individual who made the audible communication (e.g., detects physical appearance, attributes, movement, mannerisms, etc.) and, based characteristics of the individual the system determines whether the audible communication is a direct command to perform an action or present content related to the wagering game session or whether the audible communication is an indirect comment.

In some embodiments, the system analyzes a history of a player's communication to determine when, and how often, a player makes passive comments. In some embodiments, the system refers to a library of gaming commands and indirect comments. The library includes descriptions of specific words or phrases that indicate commands as well as specific words or phrases that indicate indirect comments.

In some embodiments, the system evaluates at least one characteristic of the one or more audible communications in context of one or more characteristics or conditions associated with the wagering game session, as similarly described previously in FIG. 2. For example, in some embodiments, the one or more audible communications are related to wagering game content presented during the wagering game session.

The system determines an automated response to present based on the one or more audible communications being related to the wagering game content.

The flow 500 continues at processing block 504 where the system determines an automated response to present based on the one or more audible communications. For instance, the system can passively, or subtly, present content that is related to the indirect audible communication. For instance, if the audible communication is an indirect comment that indicates a preference for content, the system can suggest related gaming content, or incorporate related content into wagering games.

The flow 500 continues at processing block 506, where the system delays a presentation of the automated response based on determination that the one or more audible communications are indirectly communicated. In some embodiments, the system continually, and subtly, presents relevant information via the wagering game machine in a way that corresponds to the comments. However, the system may delay the presentation of content so that the response is subtle. In other words, the delay can prevent the automated response from appearing as if it is in immediate response to the indirect audible communication. Thus, the system can present relevant information in a way that does not appear to be an obvious response to the player's indirect audible communication. Prior to delaying the presenting of a response, the system determines that the audible communication does not indicate an immediate response (e.g., if the audible communication is indirect, then the individual is not expecting a direct response and so the system determines that it can delay the response).

Some examples of delaying a response may include, but are not limited to, the following:

- Delaying presentation of an automated response for a predetermined time period after detecting an audible communication.
- For example the system delays changes of content for a certain time period (e.g., at a first time, the system detects an audible communication that indicates a preference for specific content, and, after a default delay period, the system presents an advertisement or a suggestion for content).
- Delaying presentation of the response until an additional gaming event occurs. For instance, the system may delay presenting content until the player attains a specific achievement or until secondary content is activated (e.g., delay a response until the wagering game hits a specific slot-reel configuration, delay a response until the wagering game presents a specific hand, delay a response until a gaming event triggers a bonus round, etc.).
- Delaying presentation of the response until the player performs an activity. For example, in some embodiments, the system delays a response until a player accesses a player account (e.g., delays presenting a customized content related to the audible communication until the player accesses a menu feature of the player account). In some embodiments, the system delays presentation until the player has spent a specific amount of money or until the player repeats a specific phrase.
- Delaying presentation of scheduled content. For example, the system delays presentation of scheduled presentation of slot reels to increase sense of anticipation of a wagering game outcome. For example, the system spins reels according to a command to spin the reels. The system has a default, scheduled amount of time to present a reel-spin effect for each reel. During the reel spins, the system detects a player's audible communication that says, "Come on . . . come on." In response to the player's audible communication, the system can draw out the default, scheduled amount of time that the reels spin. During the drawn out period, the system may offer other wagering options (e.g., "Would you like to side-bet on the outcome of this reel?").

Although FIG. 5 describes delaying a presentation of an automated response based on an audible communication being indirect, the system can delays responses in various other situations. For example, in some embodiments, the system delays an automated response to a direct audible communication. For instance, the system detects that a player directly commands the system to track spending. The system accumulates data for the spending. Subsequently, the system responds at a later time with aggregate data of the spending. In some examples, the system can respond both directly (e.g., immediately) and indirectly (e.g., with delays). For instance, the system detects a comment that indicates a preference for particular theme (e.g., the player says "I love race cars.") which the system can respond to at one or more different subsequent times. For instance, at a first time, a player says, "I love racecars" (e.g., passive) or "Show me games about racing" (direct). In response, the system can immediately respond with suggestions with racing games and/or respond minutes later, or in some other way that does not appear to be immediately in response to the comment with suggestions for content related to racing. In another example, the system can respond when the player requests to view a menu display (e.g., a game selection menu). For instance, at a later time, when the player's accesses a game selection menu, the system shows graphical images of cars in the game selection in response to the earlier request to show the player games about racing. In yet other embodiments, the system can refrain from presenting content (e.g., so as not to patronize a player or cause an individual to experience an additional event or content that may increase a negative emotion).

Figure 6:
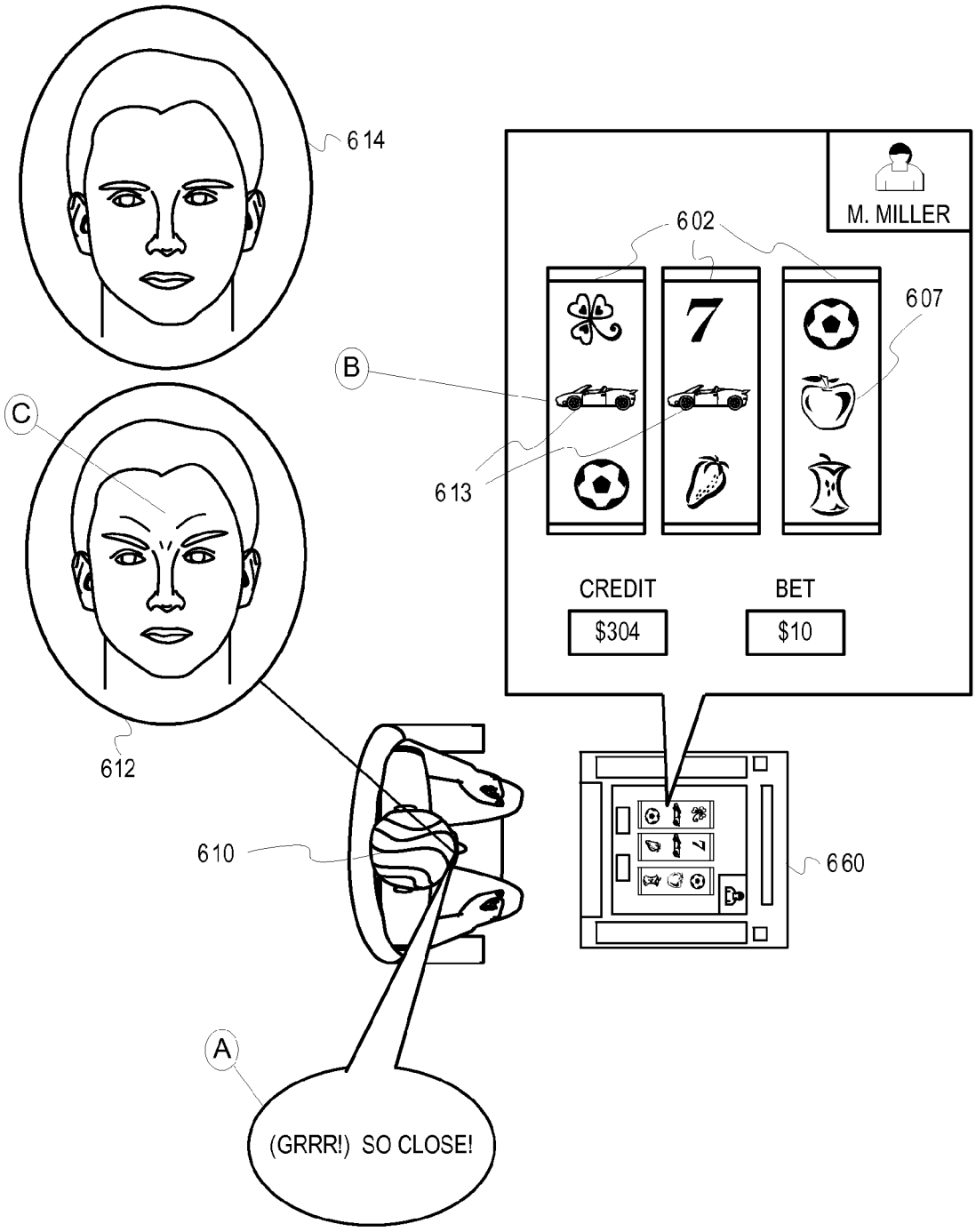
FIG. 6 is an illustration of detecting and interpreting the meaning of an indirect audible communication made during gaming, according to some embodiments.
Figure 7:
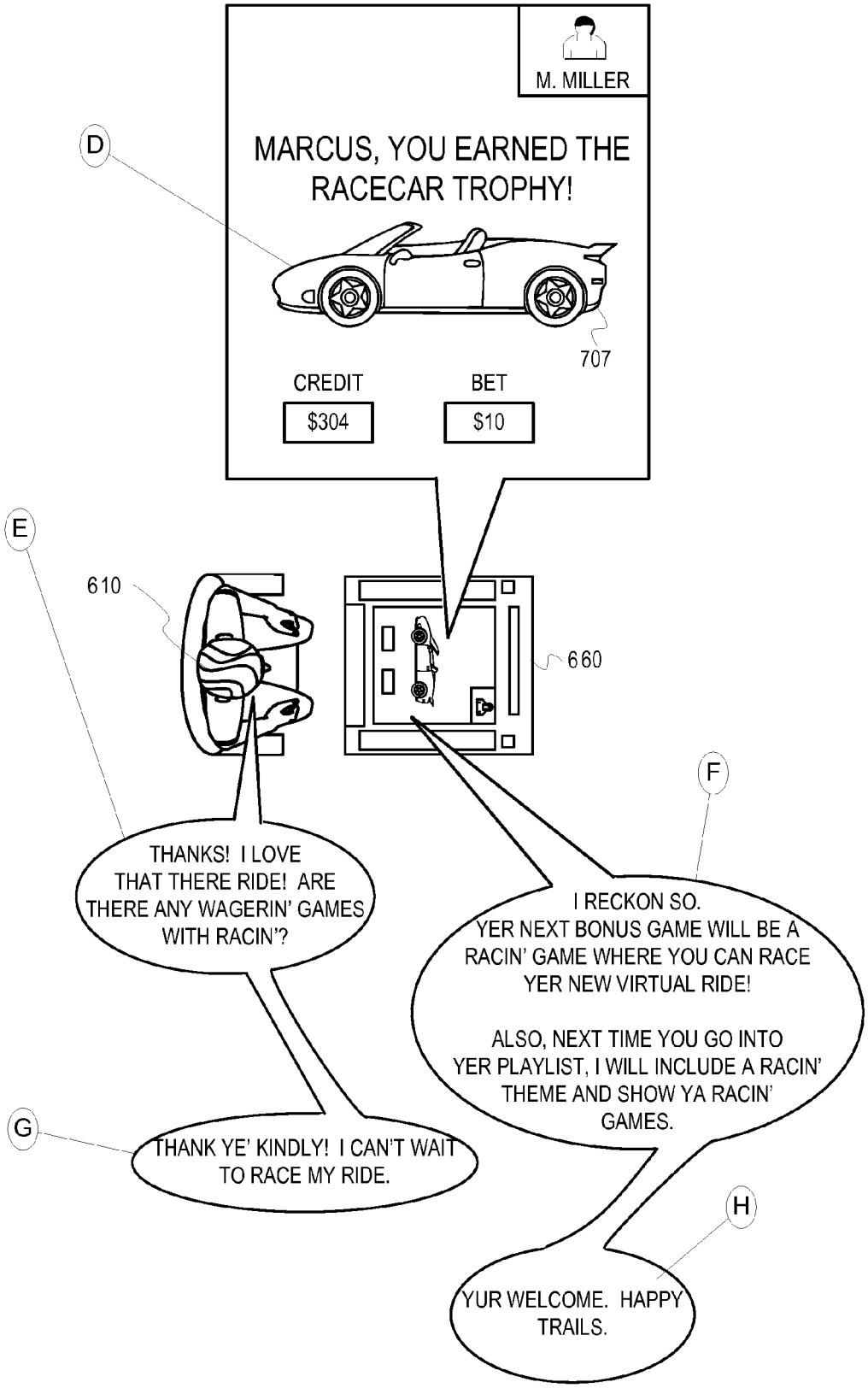
FIG. 7 is an illustration of responding to indirect audible communication made during gaming, according to some embodiments.

FIGS. 6 and 7 illustrate an example of some of the concepts described previously. In FIGS. 6 and 7, the system performs various operations at various stages (i.e., stages "A" through "H"). In FIG. 6, a player 610 is seated at, and logged in to, a wagering game machine 660. At stage "A," the system detects an audible communication by the player 610 (i.e., the comment "(Grrr!) So close!"), which indicates a degree of frustration. The system analyzes the situation and determines that the audible communication made by the player 610 is not directed to the system, but is an indirect audible communication. The system further detects a potential negative tone of the audible communication. For instance, the system analyzes the situation by detecting, at stage "B," that the wagering game played by the player 610 had a reel-stop configuration that was a near-win (e.g., the symbols 613 were lined up along a potential pay line and would have generated a win if the symbol 607 had matched the symbols 613). The system also analyzes past playing history and a history of audible comments to detect whether the player has a history of making negative audible communications to asses a degree of level of priority for a response. Furthermore, the system, at stage "C," analyzes physical aspects of the player 610. For example, the system compares a current recorded image 612 of the player 610 to a previously recorded image 614. The current recorded image 612 includes a facial appearance of the player 610 at stage "A," which facial appearance indicates visible signs of a negative emotional state (e.g., furrowed brow). The previously recorded image 614 includes a facial appearance of the player 610 when the player 610 is in a neutral emotional state. Based on analysis of the situation (including analysis of an audible communication, physical appearance, game state, player history, etc.), the system detects that the player 610 is making an indirect communication (versus a direct communication) and that the player is in a negative emotional state. Furthermore, the system detects a meaning of the verbal and non-verbal content of the phrase "(Grrr!) So close." For instance, the system compares the content of the audible communication to a database of known phrases (e.g., "(Grrr!)" is indicated in a sound library of non-verbal speech as sound that typically indicates a negative emotion and the phrase "So close!" is indicated in a speech library, related to gaming, as an indication of a near-win).

In response to detecting the meaning of, and emotional expression associated with, the audible communication (e.g., in response to detecting that the player 610 has experienced a near-win and that player 610 is in a negative emotional state), the system attempts to address the negative emotional state with a positive comment and/or reward. For instance, in FIG. 7, at stage "D," the system presents a virtual racecar trophy ("virtual trophy 707"). The system customizes the form of the virtual trophy to appear as a racecar based on player preferences. For example, the system may have detected, from previous audible communications, that the player likes racecars (e.g., see FIG. 4). At stage "E," the system detects an additional audible communication that indicates a positive emotion. Furthermore, the system detects an additional audible communication that requests a specific type of content (e.g., "Are there any wagerin' games with racin'?"). The system detects a specific dialect by the player 610 (e.g., a southern accent) and attempts to respond, at stages "F" and "H," in a way that is customized to the player's dialect and vernacular (e.g., "I reckon so . . . racin' . . . yer . . . ya . . . happy trails"). Furthermore, the system indicates, at stage "F," that the player can utilize the virtual trophy 607 in a subsequent bonus game (i.e., "Yer next bonus game will be a racin' game where you can ride yer new virtual ride"). The system has an option to present various types of bonus games and customize the bonus game to include content that is customized to the player (e.g., introduce the virtual trophy 607 into the bonus game). The system incorporates the word "ride" as a customized word that the player may have previously used to describe a vehicle (e.g., see FIG. 4). At stage "F," the system further suggests additional content that the player 610 may prefer (e.g., "Also, next time you go into yer playlist, I will include a racin' theme and show ya' racin' games.") At stage "G," the system detects an audible communication that indicates satisfaction and an indication that the player 610 is enthusiastic to continue gambling (e.g., "Thank ye' kindly! I can't wait to race my ride."). At stage "H," the system detects that the responses have evoked a positive emotion in the player 610 and so the system terminates communication with a customized salutation ("Yur welcome. Happy trails.").

Example Operating Environments

This section describes example operating architectures, systems, networks, etc. and presents structural aspects of some embodiments.

Wagering Game System Architecture

Figure 8:
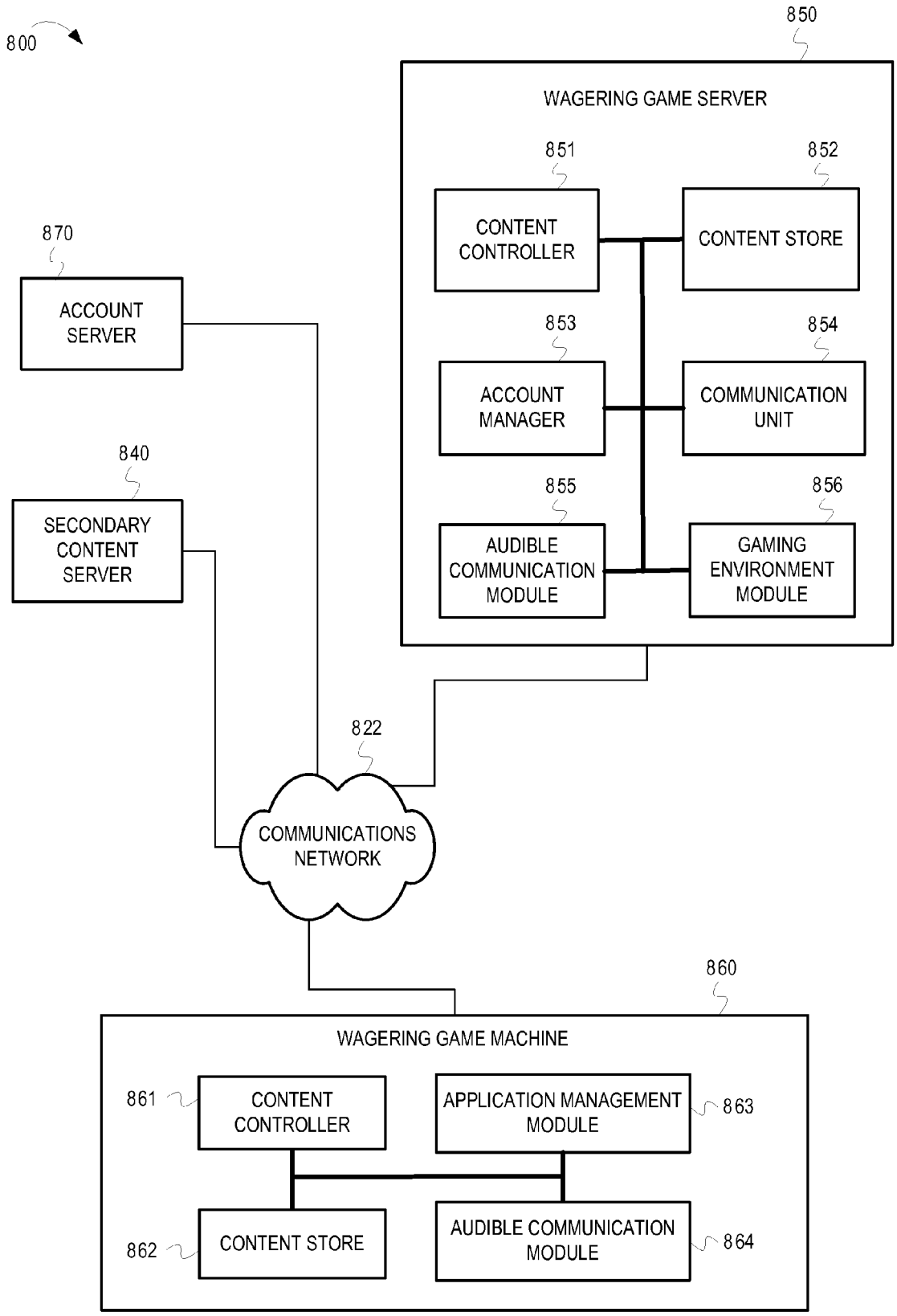
FIG. 8 is an illustration of a wagering game system architecture 800, according to some embodiments.

FIG. 8 is a conceptual diagram that illustrates an example of a wagering game system architecture 800, according to some embodiments. The wagering game system architecture 800 can include an account server 870 configured to control user related accounts accessible via wagering game networks and social networks. The account server 870 can store and track player information, such as identifying information (e.g., avatars, screen name, account identification numbers, etc.) or other information like financial account information, social contact information, etc. The account server 870 can contain accounts for social contacts referenced by the player account. The account server 870 can also provide auditing capabilities, according to regulatory rules, and track the performance of players, machines, and servers. The account server 870 can include an account controller 871 configured to control information for a player's account. The account server 870 can also include an account store 872 configured to store information for a player's account.

The wagering game system architecture 800 can also include a wagering game server 850 configured to control wagering game content, provide random numbers, and communicate wagering game information, account information, and other information to and from a wagering game machine 860. The wagering game server 850 can include a content controller 851 configured to manage and control content for presentation on the wagering game machine 860. For example, the content controller 851 can generate game results (e.g., win/loss values), including win amounts, for games played on the wagering game machine 860. The content controller 851 can communicate the game results to the wagering game machine 860. The content controller 851 can also generate random numbers and provide them to the wagering game machine 860 so that the wagering game machine 860 can generate game results. The wagering game server 850 can also include a content store 852 configured to contain content to present on the wagering game machine 860. The wagering game server 850 can also include an account manager 853 configured to control information related to player accounts. For example, the account manager 853 can communicate wager amounts, game results amounts (e.g., win amounts), bonus game amounts, etc., to the account server 870. The wagering game server 850 can also include a communication unit 854 configured to communicate information to the wagering game machine 860 and to communicate with other systems, devices and networks. The wagering game server 850 can also include an audible communication module 855 configured to detect audible communications and generate automated responses based on audible communications. The wagering game server 850 can also include a gaming environment module 856 configured to control environmental sounds, lights, etc.

The wagering game system architecture 800 can also include the wagering game machine 860 configured to present wagering games and receive and transmit information to detect and respond to audible communications for gaming. The wagering game machine 860 can include a content controller 861 configured to manage and control content and presentation of content on the wagering game machine 860. The wagering game machine 860 can also include a content store 862 configured to contain content to present on the wagering game machine 860. The wagering game machine 860 can also include an application management module 863 configured to manage multiple instances of gaming applications. For example, the application management module 863 can be configured to launch, load, unload and control applications and instances of applications. The application management module 863 can launch different software players (e.g., a Microsoft® Silverlight™ player, an Adobe® Flash® player, etc.) and manage, coordinate, and prioritize what the software players do. The application management module 863 can also coordinate instances of server applications in addition to local copies of applications. The application management module 863 can control window locations on a wagering game screen or display for the multiple gaming applications. In some embodiments, the application management module 863 can manage window locations on multiple displays including displays on devices associated with and/or external to the wagering game machine 860 (e.g., a top display and a bottom display on the wagering game machine 860, a peripheral device connected to the wagering game machine 860, a mobile device connected to the wagering game machine 860, etc.). The application management module 863 can manage priority or precedence of client applications that compete for the same display area. For instance, the application management module 863 can determine each client application's precedence. The precedence may be static (i.e. set only when the client application first launches or connects) or dynamic. The applications may provide precedence values to the application management module 863, which the application management module 863 can use to establish order and priority. The precedence, or priority, values can be related to tilt events, administrative events, primary game events (e.g., hierarchical, levels, etc.), secondary game events, local bonus game events, advertising events, etc. As each client application runs, it can also inform the application management module 863 of its current presentation state. The applications may provide presentation state values to the application management module 863, which the application management module 863 can use to evaluate and assess priority. Examples of presentation states may include celebration states (e.g., indicates that client application is currently running a win celebration), playing states (e.g., indicates that the client application is currently playing), game starting states (e.g., indicates that the client application is showing an invitation or indication that a game is about to start), status update states (e.g., indicates that the client application is not 'playing' but has a change of status that should be annunciated, such as a change in progressive meter values or a change in a bonus game multiplier), idle states (e.g., indicates that the client application is idle), etc. In some embodiments, the application management module 863 can be pre-configurable. The system can provide controls and interfaces for operators to control screen layouts and other presentation features for the configuring of the application management module 863. The application management module 863 can communicate with, and/or be a communication mechanism for, a base game stored on a wagering game machine. For example, the application management module 863 can communicate events from the base game such as the base game state, pay line status, bet amount status, etc. The application management module 863 can also provide events that assist and/or restrict the base game, such as providing bet amounts from secondary gaming applications, inhibiting play based on gaming event priority, etc. The application management module 863 can also communicate some (or all) financial information between the base game and other applications including amounts wagered, amounts won, base game outcomes, etc. The application management module 863 can also communicate pay table information such as possible outcomes, bonus frequency, etc.

In some embodiments, the application management module 863 can control different types of applications. For example, the application management module 863 can perform rendering operations for presenting applications of varying platforms, formats, environments, programming languages, etc. For example, the application management module 863 can be written in one programming language format (e.g., Javascript, Java, C++, etc.) but can manage, and communicate data from applications that are written in other programming languages or that communicate in different data formats (e.g., Adobe® Flash®, Microsoft® Silverlight™, Adobe® Air™, hyper-text markup language, etc.). The application management module 863 can include a portable virtual machine capable of generating and executing code for the varying platforms, formats, environments, programming languages, etc. The application management module 863 can enable many-to-many messaging distribution and can enable the multiple applications to communicate with each other in a cross-manufacturer environment at the client application level. For example, multiple gaming applications on a wagering game machine may need to coordinate many different types of gaming and casino services events (e.g., financial or account access to run spins on the base game and/or run side bets, transacting drink orders, tracking player history and player loyalty points, etc.).

The wagering game machine 860 can also include an audible communication module 864 configured to detect audible communications and generate automated responses based on audible communications.

The wagering game system architecture 800 can also include a secondary content server 840 configured to provide content and control information for secondary games and other secondary content available on a wagering game network (e.g., secondary wagering game content, promotions content, advertising content, player tracking content, web content, etc.). The secondary content server 880 can provide "secondary" content, or content for "secondary" games presented on the wagering game machine 860. "Secondary" in some embodiments can refer to an application's importance or priority of the data. In some embodiments, "secondary" can refer to a distinction, or separation, from a primary application (e.g., separate application files, separate content, separate states, separate functions, separate processes, separate programming sources, separate processor threads, separate data, separate control, separate domains, etc.). Nevertheless, in some embodiments, secondary content and control can be passed between applications (e.g., via application protocol interfaces), thus becoming, or falling under the control of, primary content or primary applications, and vice versa. In some embodiments, the secondary content can be in one or more different formats, such as Adobe® Flash®, Microsoft® Silverlight™, Adobe® Air™, hyper-text markup language, etc. In some embodiments, the secondary content server 880 can provide and control content for community games, including networked games, social games, competitive games, or any other game that multiple players can participate in at the same time. In some embodiments, the secondary content server 880 can control and present an online website that hosts wagering games. The secondary content server 880 can also be configured to present multiple wagering game applications on the wagering game machine 860 via a wagering game website, or other gaming-type venue accessible via the Internet. The secondary content server 880 can host an online wagering website and/or a social networking website. The secondary content server 880 can include other devices, servers, mechanisms, etc., that provide functionality (e.g., controls, web pages, applications, etc.) that web users can use to connect to a social networking application and/or website and utilize social networking and website features (e.g., communications mechanisms, applications, etc.). In some embodiments, the secondary content server 880 can also host social networking accounts, provide social networking content, control social networking communications, store associated social contacts, etc. The secondary content server 880 can also provide chat functionality for a social networking website, a chat application, or any other social networking communications mechanism. In some embodiments, the secondary content server 880 can utilize player data to determine marketing promotions that may be of interest to a player account. The secondary content server 880 can also analyze player data and generate analytics for players, group players into demographics, integrate with third party marketing services and devices, etc. The secondary content server 880 can also provide player data to third parties that can use the player data for marketing. In some embodiments, the secondary content server 880 can provide one or more social networking communication mechanisms that publish (e.g., post, broadcast, etc.) a message to a mass (e.g., to multiple people, users, social contacts, accounts, etc.). The social networking communication mechanism can publish the message to the mass simultaneously. Examples of the published message may include, but not be limited to, a blog post, a mass message post, a news feed post, a profile status update, a mass chat feed, a mass text message broadcast, a video blog, a forum post, etc. Multiple users and/or accounts can access the published message and/or receive automated notifications of the published message.

Each component shown in the wagering game system architecture 800 is shown as a separate and distinct element connected via a communications network 822. However, some functions performed by one component could be performed by other components. For example, the wagering game server 850 can also be configured to perform functions of the application management module 863, the audible communication module 864, and other network elements and/or system devices. Furthermore, the components shown may all be contained in one device, but some, or all, may be included in, or performed by, multiple devices, as in the configurations shown in FIG. 8 or other configurations not shown. For example, the account manager 253 and the communication unit 254 can be included in the wagering game machine 860 instead of, or in addition to, being a part of the wagering game server 250. Further, in some embodiments, the wagering game machine 860 can determine wagering game outcomes, generate random numbers, etc. instead of, or in addition to, the wagering game server 250.

The wagering game machines described herein (e.g., wagering game machine 860) can take any suitable form, such as floor standing models, handheld mobile units, bar-top models, workstation-type console models, surface computing machines, etc. Further, wagering game machines can be primarily dedicated for use in conducting wagering games, or can include non-dedicated devices, such as mobile phones, personal digital assistants, personal computers, etc.

In some embodiments, wagering game machines and wagering game servers work together such that wagering game machines can be operated as thin, thick, or intermediate clients. For example, one or more elements of game play may be controlled by the wagering game machines (client) or the wagering game servers (server). Game play elements can include executable game code, lookup tables, configuration files, game outcome, audio or visual representations of the game, game assets or the like. In a thin-client example, the wagering game server can perform functions such as determining game outcome or managing assets, while the wagering game machines can present a graphical representation of such outcome or asset modification to the user (e.g., player). In a thick-client example, the wagering game machines can determine game outcomes and communicate the outcomes to the wagering game server for recording or managing a player's account.

In some embodiments, either the wagering game machines (client) or the wagering game server(s) can provide functionality that is not directly related to game play. For example, account transactions and account rules may be managed centrally (e.g., by the wagering game server(s)) or locally (e.g., by the wagering game machines). Other functionality not directly related to game play may include power management, presentation of advertising, software or firmware updates, system quality or security checks, etc.

Furthermore, the wagering game system architecture 800 can be implemented as software, hardware, any combination thereof, or other forms of embodiments not listed. For example, any of the network components (e.g., the wagering game machines, servers, etc.) can include hardware and machine-readable storage media including instructions for performing the operations described herein.

Wagering Game Computer System

Figure 9:
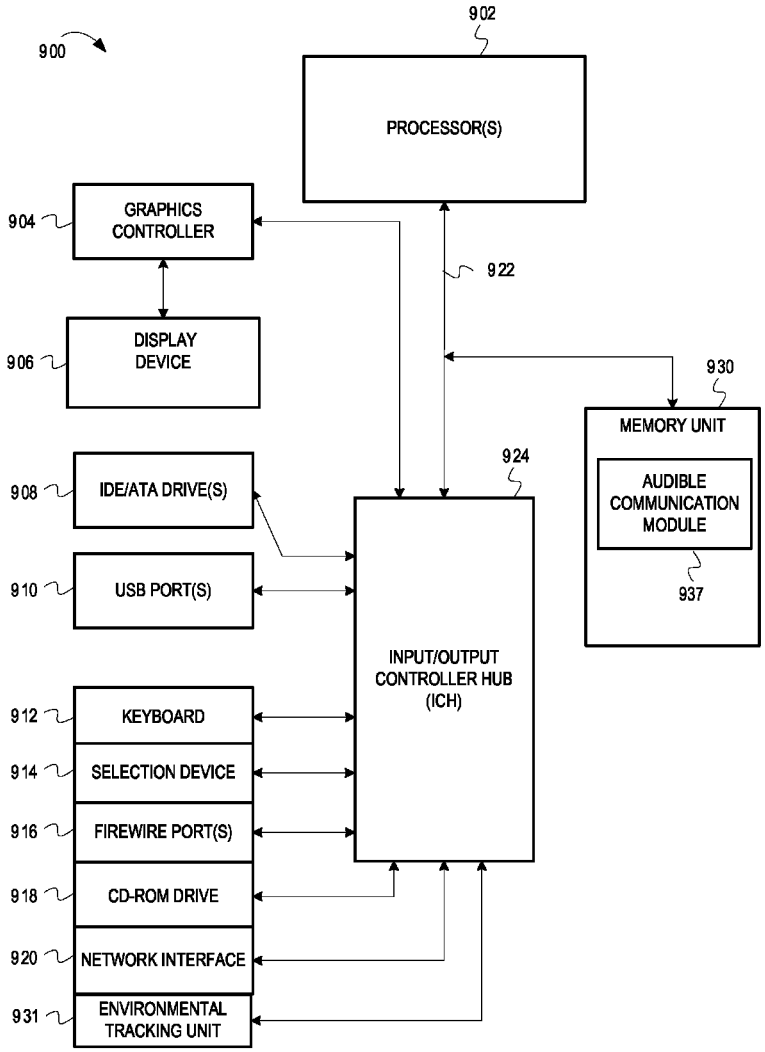
FIG. 9 is an illustration of a wagering game computer system 900, according to some embodiments.

FIG. 9 is a conceptual diagram that illustrates an example of a wagering game computer system 900, according to some embodiments. In FIG. 9, the wagering game computer system ("computer system") 900 may include a processor unit 902, a memory unit 930, a processor bus 922, and an Input/Output controller hub (ICH) 924. The processor unit 902, memory unit 930, and ICH 924 may be coupled to the processor bus 922. The processor unit 902 may comprise any suitable processor architecture. The computer system 900 may comprise one, two, three, or more processors, any of which may execute a set of instructions in accordance with some embodiments.

The memory unit 930 may also include an I/O scheduling policy unit and I/O schedulers. The memory unit 930 can store data and/or instructions, and may comprise any suitable memory, such as a dynamic random access memory (DRAM), for example. The computer system 900 may also include one or more suitable integrated drive electronics (IDE) drive(s) 908 and/or other suitable storage devices. A graphics controller 904 controls the display of information on a display device 906, according to some embodiments.

The ICH 924 provides an interface to I/O devices or peripheral components for the computer system 900. The ICH 924 may comprise any suitable interface controller to provide for any suitable communication link to the processor unit 902, memory unit 930 and/or to any suitable device or component in communication with the ICH 924. The ICH 924 can provide suitable arbitration and buffering for each interface.

For one embodiment, the ICH 924 provides an interface to the one or more IDE drives 908, such as a hard disk drive (HDD) or compact disc read only memory (CD ROM) drive, or to suitable universal serial bus (USB) devices through one or more USB ports 910. For one embodiment, the ICH 924 also provides an interface to a keyboard 912, selection device 914 (e.g., a mouse, trackball, touchpad, etc.), CD-ROM drive 918, and one or more suitable devices through one or more firewire ports 916. For one embodiment, the ICH 924 also provides a network interface 920 through which the computer system 900 can communicate with other computers and/or devices.

The computer system 900 may also include a machine-readable storage medium that stores a set of instructions (e.g., software) embodying any one, or all, of the methodologies to detect and respond to audible communications for gaming. Furthermore, software can reside, completely or at least partially, within the memory unit 930 and/or within the processor unit 902. The computer system 900 can also include an audible communication module 937. The audible communication module 937 can process communications, commands, or other information, to detect and respond to audible communications for gaming. In some embodiments, the computer system 900 includes an environmental tracking unit 931 that includes microphones, cameras, sensors, or other devices used to capture sounds, images, or other characteristics of an environment in which the computer system 900 is situated. For example, the environmental tracking unit 931 can record sounds and images associated with individuals that make audible communications. Any component of the computer system 900 can be implemented as hardware, firmware, and/or machine-readable storage media including instructions for performing the operations described herein.

Wagering Game Machine Architecture

Figure 10:
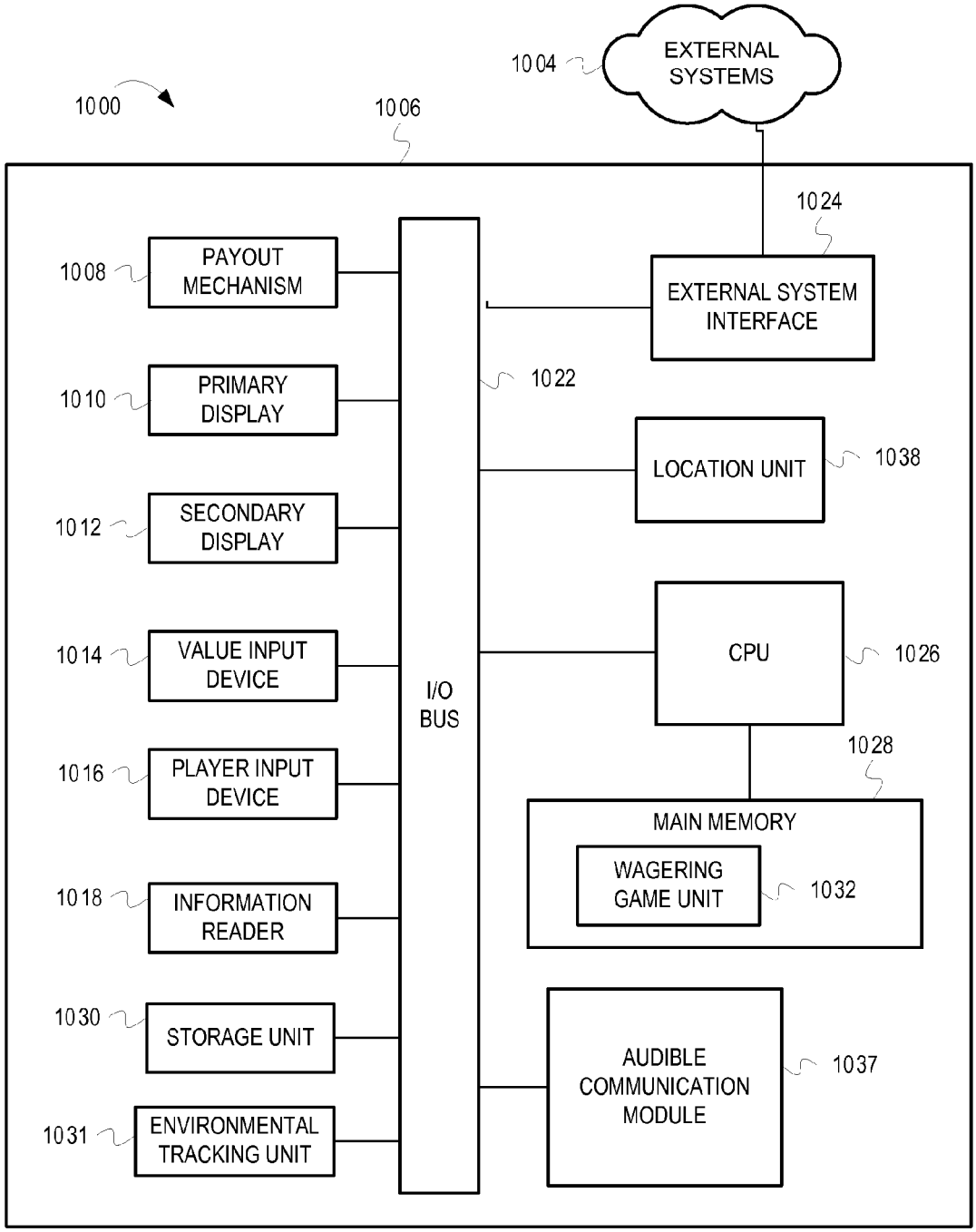
FIG. 10 is an illustration of a wagering game machine architecture 1000, according to some embodiments.

FIG. 10 is a conceptual diagram that illustrates an example of a wagering game machine architecture 1000, according to some embodiments. In FIG. 10, the wagering game machine architecture 1000 includes a wagering game machine 1006, which includes a central processing unit (CPU) 1026 connected to main memory 1028. The CPU 1026 can include any suitable processor, such as an Intel® Pentium processor, Intel® Core 2 Duo processor, AMD Opteron™ processor, or UltraSPARC processor. The main memory 1028 includes a wagering game unit 1032. In some embodiments, the wagering game unit 1032 can present wagering games, such as video poker, video black jack, video slots, video lottery, reel slots, etc., in whole or part.

The CPU 1026 is also connected to an input/output ("I/O") bus 1022, which can include any suitable bus technologies, such as an AGTL+ frontside bus and a PCI backside bus. The I/O bus 1022 is connected to a payout mechanism 1008, primary display 1010, secondary display 1012, value input device 1014, player input device 1016, information reader 1018, and storage unit 1030. The player input device 1016 can include the value input device 1014 to the extent the player input device 1016 is used to place wagers. The I/O bus 1022 is also connected to an external system interface 1024, which is connected to external systems 1004 (e.g., wagering game networks). The external system interface 1024 can include logic for exchanging information over wired and wireless networks (e.g., 802.11g transceiver, Bluetooth transceiver, Ethernet transceiver, etc.)

The I/O bus 1022 is also connected to a location unit 1038. The location unit 1038 can create player information that indicates the wagering game machine's location/movements in a casino. In some embodiments, the location unit 1038 includes a global positioning system (GPS) receiver that can determine the wagering game machine's location using GPS satellites. In other embodiments, the location unit 1038 can include a radio frequency identification (RFID) tag that can determine the wagering game machine's location using RFID readers positioned throughout a casino. Some embodiments can use GPS receiver and RFID tags in combination, while other embodiments can use other suitable methods for determining the wagering game machine's location. Although not shown in FIG. 10, in some embodiments, the location unit 1038 is not connected to the I/O bus 1022.

In some embodiments, the wagering game machine 1006 can include additional peripheral devices and/or more than one of each component shown in FIG. 10. For example, in some embodiments, the wagering game machine 1006 can include multiple external system interfaces 1024 and/or multiple CPUs 1026. In some embodiments, any of the components can be integrated or subdivided.

In some embodiments, the wagering game machine 1006 includes an audible communication module 1037. The audible communication module 1037 can process communications, commands, or other information, where the processing can detect and respond to audible communications for gaming. In some embodiments, the wagering game machine 1006 includes an environmental tracking unit 1031 that includes microphones, cameras, sensors, or other devices used to capture sounds, images, or other characteristics of an environment in which the wagering game machine 1006 is situated. For example, the environmental tracking unit 1031 can record sounds and images associated with individuals that make audible communications.

Furthermore, any component of the wagering game machine 1006 can include hardware, firmware, and/or machine-readable storage media including instructions for performing the operations described herein.

Wagering Game System

Figure 11:
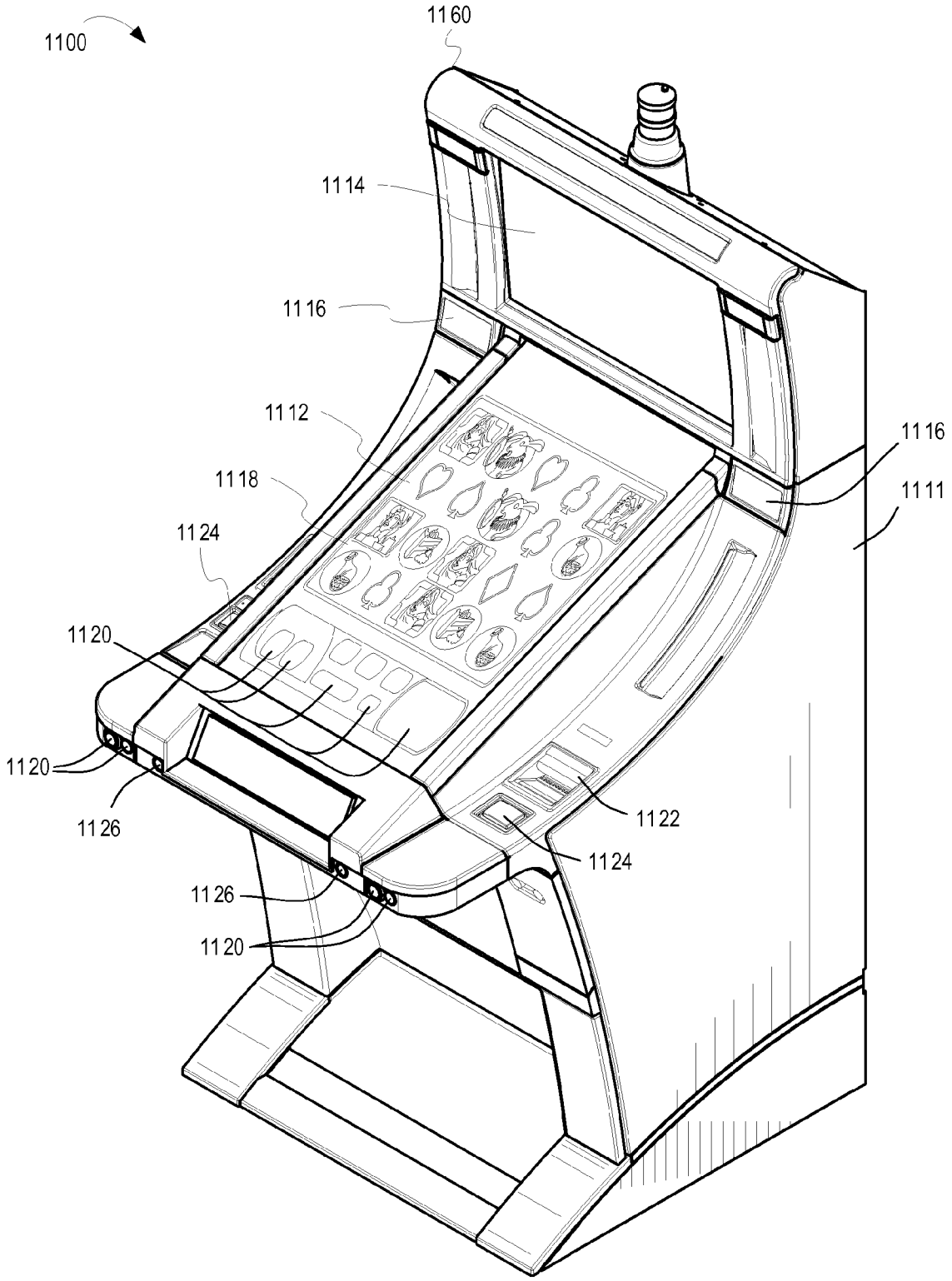
FIG. 11 is an illustration of a wagering game system 1100, according to some embodiments.

FIG. 11 is a conceptual diagram that illustrates an example of a wagering game system 1100, according to some embodiments. In FIG. 11, the wagering game system 1100 includes a wagering game machine 1160 similar to those used in gaming establishments, such as casinos. The wagering game machine 1160 may, in some examples, be referred to as a gaming terminal or an electronic gaming machine. The wagering game machine 1160 may have varying structures and methods of operation. For example, the wagering game machine 1160 may include electromechanical components configured to play mechanical slots. In another example, the 1160 includes electronic components configured to play a video casino game, such as slots, keno, poker, blackjack, roulette, craps, etc. The wagering game machine 1160 is depicted as a floor-standing model. However, other examples of wagering game machines include handheld mobile units, bartop models, workstation-type console models, etc. Further, the wagering game machine 1160 may be primarily dedicated for use in conducting wagering games, or may include non-dedicated devices, such as mobile phones, personal digital assistants, personal computers, etc. Exemplary types of wagering game machines are disclosed in U.S. Pat. No. 6,517,433 and Patent Application Publication Nos. US2010/0062196 and US2010/0234099, which are incorporated herein by reference in their entireties.

The wagering game machine 1160 illustrated in FIG. 11 comprises a cabinet 1111 that may house various input devices, output devices, and input/output devices. By way of example, the wagering game machine 1160 includes a primary display area 1112, a secondary display area 1114, and one or more audio speakers 1116. The primary display area 1112 or the secondary display area 1114 may include one or more of a cathode ray tube (CRT), a high resolution liquid crystal display (LCD), a plasma display, a light emitting diode (LED) display, a three-dimensional (3D) display, a video display, or a combination thereof. In some examples, the primary display area 1112 or the secondary display area 1114 includes mechanical reels to display a wagering game outcome. In some example, the primary display area 1112 or the secondary display area 1114 present a transmissive video display disposed in front of a mechanical-reel display to portray a video image superimposed upon the mechanical-reel display. In FIG. 11, the wagering game machine 1160 is a "slant-top" version in which the primary display 1112 is slanted (e.g., at about a thirty-degree angle toward the player of the wagering game machine 1160). Another example of wagering game machine 1160 is an "upright" version in which the primary display 1114 is oriented vertically relative to the player. The display areas may variously display information associated with wagering games, non-wagering games, community games, progressives, advertisements, services, premium entertainment, text messaging, emails, alerts, announcements, broadcast information, subscription information, etc. appropriate to the particular mode(s) of operation of the wagering game machine 1160. The wagering game machine 1160 includes a touch screen(s) 1118 mounted over the primary or secondary areas, buttons 1120 on a button panel, bill validator 1122, information reader/writer(s) 1124, and player-accessible port(s) 1126 (e.g., audio output jack for headphones, video headset jack, USB port, wireless transmitter/receiver, etc.). It should be understood that numerous other peripheral devices and other elements exist and are readily utilizable in any number of combinations to create various forms of a wagering game machine in accord with the present concepts.

Input devices, such as the touch screen 1118, buttons 1120, a mouse, a joystick, a gesture-sensing device, a voice-recognition device, and a virtual input device, accept player input(s) and transform the player input(s) to electronic data signals indicative of the player input(s), which correspond to an enabled feature for such input(s) at a time of activation (e.g., pressing a "Max Bet" button or soft key to indicate a player's desire to place a maximum wager to play the wagering game). The input(s), once transformed into electronic data signals, are output to a CPU for processing. The electronic data signals are selected from a group consisting essentially of an electrical current, an electrical voltage, an electrical charge, an optical signal, an optical element, a magnetic signal, and a magnetic element.

Embodiments may take the form of an entirely hardware embodiment, an entirely software embodiment (including firmware, resident software, micro-code, etc.) or an embodiment combining software and hardware aspects that may all generally be referred to herein as a "circuit," "module" or "system." Furthermore, embodiments of the inventive subject matter may take the form of a computer program product embodied in any tangible medium of expression having computer readable program code embodied in the medium. The described embodiments may be provided as a computer program product that may include a machine-readable storage medium having stored thereon instructions, which may be used to program a computer system to perform a process according to embodiments(s), whether presently described or not, because every conceivable variation is not enumerated herein. A machine-readable storage medium includes any mechanism that stores information in a form readable by a machine (e.g., a wagering game machine, computer, etc.). For example, machine-readable storage media includes read only memory (ROM), random access memory (RAM), magnetic disk storage media, optical storage media (e.g., CD-ROM), flash memory machines, erasable programmable memory (e.g., EPROM and EEPROM); etc. Some embodiments of the invention can also include machine-readable signal media, such as any media suitable for transmitting software over a network.

General

This detailed description refers to specific examples in the drawings and illustrations. These examples are described in sufficient detail to enable those skilled in the art to practice the inventive subject matter. These examples also serve to illustrate how the inventive subject matter can be applied to various purposes or embodiments. Other embodiments are included within the inventive subject matter, as logical, mechanical, electrical, and other changes can be made to the example embodiments described herein. Features of various embodiments described herein, however essential to the example embodiments in which they are incorporated, do not limit the inventive subject matter as a whole, and any reference to the invention, its elements, operation, and application are not limiting as a whole, but serve only to define these example embodiments. This detailed description does not, therefore, limit embodiments, which are defined only by the appended claims. Each of the embodiments described herein are contemplated as falling within the inventive subject matter, which is set forth in the following claims.

The invention claimed is:

1. A method of operating a gaming system configured to present a wagering game session, said method comprising:

detecting, via the gaming system, a first audible communication made during the wagering game session;

determining, via the gaming system, that the first audible communication pertains to gaming information associated with the wagering game session;

evaluating, via the gaming system, the first audible communication against a second audible communication made during the wagering game session;

assigning a first relevance value to the first audible communication based on the evaluating;

assigning a second relevance value to the second audible communication based on the evaluating, wherein the second relevance value is different from the first relevance value;

generating an automated response based on one or more of the first relevance value and the second relevance value; and presenting the automated response via an output device associated with the gaming system.

2. The method of claim 1, wherein the detecting the first audible communication comprises:

detecting a sound in an environment associated with a wagering game machine associated with the wagering game session; and determining, based on a characteristic of the sound, that the sound originates from a position, relative to the wagering game machine, associated with a participant of the wagering game session, wherein the first audible communication comprises one or more of a spoken word of the participant, a spoken phrase of the participant, a vocal sound of the participant, an oral noise of the participant, a sound made by physical activity of the participant, and a sound made by use of a personal item associated with the participant.

3. The method of claim 1 further comprising determining a meaning of the first audible communication based on evaluation of a characteristic of the first audible communication against the gaming information, and further comprising generating the automated response based on the meaning.

4. The method of claim 1, wherein the evaluating the first audible communication against the second audible communication comprises:

determining a first physical appearance of a source of the first audible communication;

determining a second physical appearance of a source of the second audible communication; and evaluating the first physical appearance against the second physical appearance.

5. The method of claim 1, wherein the determining that the first audible communication pertains to the gaming information comprises evaluating at least one characteristic of the first audible communication against one or more of gaming terms, game rules, game mechanics, and verbal commands for a wagering game to one or more of perform an action and present content.

6. The method of claim 1, wherein the determining that the first audible communication pertains to the gaming information comprising determining an emotion associated with the first audible communication, and further comprising determining a timing priority for presentation of the automated response based on the emotion.

7. The method of claim 1, wherein the determining that the first audible communication pertains to the gaming information comprises determining a preference for a type of wagering game content, and further comprising presenting the automated response to include the type of wagering game content.

8. The method of claim 1, wherein the determining that the first audible communication pertains to the gaming information comprises determining a lack of understanding of one or more of game rules and game mechanics for wagering game content presented during the wagering game session, and wherein the presenting comprising presenting the automated response to suggest one or more of help for the wagering game content, shortcuts for the wagering game content, and different wagering game content.

9. An apparatus comprising:

means for detecting an audible communication made during a wagering game session;

means for evaluating a characteristic of one or more of the audible communication and an individual from which the audible communication originates, wherein the characteristic is evaluated in context with gaming information associated with the wagering game session;

means for determining a timing priority for presentation of an automated response to the audible communication based on the evaluating; and means for presenting the automated response according to the timing priority, wherein the means for presenting the automated response according to the timing priority comprises means for delaying a presentation of the automated response until after an event occurs in the wagering game session, wherein the event occurs after the determining the timing priority.

10. The apparatus of claim 9, further comprising means for customizing the automated response based on the evaluating, wherein the means for customizing the automated response based on the evaluating comprises generating the automated response to include one or more content associated with one or more of an age, an education, a profession, and a marital status of an individual.

11. One or more non-transitory, machine-readable storage media having instructions stored thereon, which when executed by a set of one or more processors cause the set of one or more processors to perform operations comprising:

detecting a sound made during a wagering game session;

determining that the sound originates from a participant of the wagering game session;

evaluating the sound against gaming information associated with the wagering game session;

determining an automated response to the sound to present based on the evaluating of the sound against the gaming information; and delaying a presentation of the automated response to the sound until after an event occurs in the wagering game session, wherein the event occurs after the determining the automated response.

12. The one or more non-transitory, machine-readable storage media of claim 11, said operations further comprising:

prioritizing the presentation of the automated response based on a directionality of the sound.

13. A system comprising:

at least one processor; and at least one memory device configured to store instructions which, when executed by the at least one processor, cause the system to perform operations to:

analyze a characteristic of a sound external to the system, based on analysis of the characteristic of the sound, determine that the sound represents an audible communication related to a presentation of wagering game content, after determination that the sound represents the audible communication related to the presentation of the wagering game content, provide a response to the audible communication for presentation via one or more output devices associated with the system, determine that the audible communication is indirectly related to the presentation of the wagering game content, and delay a presentation of the response to the audible communication based on determination that the audible communication is indirectly related to the presentation of the wagering game content.

14. The system of claim 13, wherein the at least one memory device is configured to store instructions which, when executed by the at least one processor, cause the system to perform operations to:

determine that the sound originates from a location, external to the system, from which the presentation of the wagering game content is viewable.

15. The system of claim 13, wherein the at least one memory device is configured to store instructions which, when executed by the at least one processor, cause the system to perform operations to:

evaluate the characteristic of the sound against an entry in a library that indicates a meaning associated with the characteristic of the sound;

determine a relevance value for the sound based on evaluation of the characteristic of the sound to the entry in the library; and prioritize presentation of the response to the audible communication and presentation of the wagering game content based upon the relevance value.

16. The system of claim 13, wherein the at least one memory device configured to store instructions which, when executed by the at least one processor, cause the system to perform the operation to determine that the audible communication is indirectly communicated is configured to store instructions which, when executed by the at least one processor, cause the system to perform an operation to determine that the audible communication is made with one or more passive elements of speech.

17. The system of claim 13, wherein the at least one memory device configured to store instructions which, when executed by the at least one processor, cause the system to perform the operation to determine that the audible communication is indirectly communicated is configured to store instructions which, when executed by the at least one processor, cause the system to perform an operation to:

evaluate a first image of a physical appearance of an individual from whom the sound originated to a second image of the physical appearance of the individual made before the sound was made; and determine, based on evaluation of the first image to the second image, that the individual makes an expression in the first image similar to an expression made in the second image.

18. The system of claim 13, wherein the at least one memory device is configured to store instructions which, when executed by the at least one processor, cause the system to perform operations to one or more of delay the presentation of the response until a game event occurs for the wagering game content, and delay the presentation of the response until user input is detected.

19. The method of claim 1, wherein the generating the automated response comprises generating the automated response to be more relevant to a first one of the first audible communication and the second audible communication than to a second one of the first audible communication and the second audible communication.

20. The method of claim 1, wherein one or more of the assigning the first relevance value and the assigning the second relevance value is based on one or more of a location of a first individual relative to a second individual, a location of an individual to a wagering game machine associated with the wagering game session, a social relationship between a first individual and a second individual, a spousal relationship between a first individual and a second individual, a fiduciary relationship between a first individual and a second individual, and an indication that a first individual is authorized by a second individual to make financial decisions for the second individual.

21. The apparatus of claim 9, wherein the means for determining the timing priority comprises:

means for comparing a history of previous audible communications to the audible communication; and means for determining a level of the timing priority based on the comparing the history of the previous audible communications to the audible communication.

22. The apparatus of claim 9, wherein the means for determining the timing priority comprises:

means for determining a level of emotion associated with the audible communication; and means for determining a level for the timing priority based on the level of emotion.

23. An apparatus comprising:

one or more processors;

one or more electronic output devices configured to present one or more casino wagering games for a wagering game session; and a non-transitory, machine-readable storage medium configured to store instructions, which when executed by at least one of the one or more processors, cause the apparatus to detect a first audible communication made during the wagering game session, determine that the first audible communication pertains to gaming information associated with the wagering game session, evaluate the first audible communication against a second audible communication made during the wagering game session, assign a first relevance value to the first audible communication based on evaluation of the first audible communication against the second audible communication, assign a second relevance value to the second audible communication based on the evaluation of the first audible communication against the second audible communication;

generate an automated response based on one or more of the first relevance value and the second relevance value; and present the automated response via at least one of the one or more output devices.

24. A gaming system comprising:

a gaming controller unit;

one or more electronic output devices; and a memory unit configured to store instructions, which when executed by the gaming controller unit, cause the gaming system to detect a first audible communication made during a wagering game session, determine that the first audible communication pertains to gaming information associated with the wagering game session, evaluate the first audible communication against a second audible communication made during the wagering game session based on one or more of a location of a first individual relative to a second individual, a location of an individual to a wagering game machine associated with the wagering game session, a social relationship between a first individual and a second individual, a spousal relationship between a first individual and a second individual, a fiduciary relationship between a first individual and a second individual, and an indication that a first individual is authorized by a second individual to make financial decisions for the second individual, assign one or more of a first relevance value to the first audible communication and a second relevance value to the second audible communication based on evaluation of the first audible communication against the second audible communication, and present, via the one or more electronic output devices, an automated response to the first audible communication according to the one or more of the first relevance value and the second relevance value.

25. A method of operating a gaming system, said method comprising:

detecting, via the gaming system, an audible communication made during a wagering game session;

evaluating, via the gaming system, a characteristic of one or more of the audible communication and an individual from which the audible communication originates, wherein the characteristic is evaluated in context with gaming information associated with the wagering game session;

determining, via the gaming system, a timing priority for presentation of an automated response to the audible communication based on the evaluating; and presenting, via one or more output devices associated with the gaming system, the automated response according to the timing priority, wherein the presenting the automated response according to the timing priority comprises delaying a presentation of the automated response until after an event occurs in the wagering game session, wherein the event occurs after the determining the timing priority.

26. A method of operating a gaming system comprising:

analyzing a characteristic of a sound external to the gaming system;

based on the analyzing of the characteristic of the sound, determining that the sound represents an audible communication related to a presentation of wagering game content;

after determining that the sound represents the audible communication, providing, via the gaming system, a response to the audible communication for presentation via one or more output devices associated with the gaming system;

determining, via the gaming system, that the audible communication is made with one or more passive elements of speech;

determining that the audible communication is indirectly related to the presentation of the wagering game content, based on the determining that the audible communication is made with the one or more passive elements of speech; and delaying a presentation of the response to the audible communication based on the determining that the audible communication is indirectly related to the presentation of the wagering game content.

27. One or more non-transitory, machine-readable storage media having instructions stored thereon, which when executed by a set of one or more processors of a gaming system cause the set of one or more processors to perform operations comprising:

analyzing a characteristic of a sound external to the gaming system;

based on the analyzing of the characteristic of the sound, determining that the sound represents an audible communication related to a presentation of wagering game content;

after determining that the sound represents the audible communication, providing a response to the audible communication for presentation via one or more output devices associated with the gaming system;

evaluating a first image of a physical appearance of an individual from whom the sound originated to a second image of the physical appearance of the individual, wherein the second image was made before the sound was made;

determining, based on the evaluating, that the individual makes an expression in the first image similar to an expression made in the second image;

determining that the audible communication is indirectly related to the presentation of the wagering game content, based on the determining that the individual makes the expression in the first image similar to the expression made in the second image; and delaying a presentation of the response to the audible communication based on the determining that the audible communication is indirectly related to the presentation of the wagering game content.

* * * * *